US008623785B2

(12) United States Patent
Takahama et al.

(10) Patent No.: US 8,623,785 B2
(45) Date of Patent: Jan. 7, 2014

(54) THERMAL RECORDING MATERIAL AND METHOD FOR PRODUCING THE SAME

(75) Inventors: Nobuko Takahama, Chiyoda-ku (JP); Takao Masuda, Chiyoda-ku (JP); Yoshimi Ikezawa, Chiyoda-ku (JP); Takahito Ochiai, Chiyoda-ku (JP); Shinichiro Matsumoto, Chiyoda-ku (JP); Yohei Uesugi, Chiyoda-ku (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 13/635,782

(22) PCT Filed: Mar. 28, 2011

(86) PCT No.: PCT/JP2011/057626

§ 371 (c)(1),
(2), (4) Date: Nov. 8, 2012

(87) PCT Pub. No.: WO2011/122552

PCT Pub. Date: Oct. 6, 2011

(65) Prior Publication Data

US 2013/0053240 A1 Feb. 28, 2013

(30) Foreign Application Priority Data

| | | |
|---|---|---|
| Mar. 30, 2010 | (JP) | 2010-076771 |
| Jan. 20, 2011 | (JP) | 2011-009865 |
| Jan. 27, 2011 | (JP) | 2011-014661 |
| Feb. 1, 2011 | (JP) | 2011-019598 |

(51) Int. Cl.
*B41M 5/44* (2006.01)

(52) U.S. Cl.
USPC ..... 503/226; 427/152; 427/361

(58) Field of Classification Search
CPC ..... B41M 5/44
USPC ..... 427/150–152, 361; 503/200–226
See application file for complete search history.

(56) References Cited

U.S. PATENT DOCUMENTS

| | | | |
|---|---|---|---|
| 4,912,079 | A | 3/1990 | Kawasaki et al. |
| 4,975,408 | A | 12/1990 | Motosugi et al. |
| 5,102,693 | A | 4/1992 | Motosugi et al. |
| 5,919,729 | A | 7/1999 | Mori et al. |
| 2007/0111888 | A1 | 5/2007 | Mito et al. |

FOREIGN PATENT DOCUMENTS

| | | | |
|---|---|---|---|
| JP | 52-20142 | A | 6/1974 |
| JP | 52-020142 | | 6/1977 |
| JP | 59-5093 | A | 1/1984 |

(Continued)

*Primary Examiner* — Bruce H Hess
(74) *Attorney, Agent, or Firm* — Fitzpatrick, Cella, Harper & Scinto

(57) ABSTRACT

Provided is a thermal recording material comprising an intermediate layer and a heat-sensitive recording layer for color formation by heat stacked in this order onto a support, the thermal recording material being characterized in that the intermediate layer contains a bellows-shaped hollow resin and that the roughness of the surface on the color forming side is 1.0 μm or less as measured by Parker Print Surf. The method for producing such a thermal recording material comprises the steps of:

applying a coating liquid containing heat-expandable resin particles to a support, drying the coated support at a temperature lower than the expansion starting temperature of the heat-expandable resin particle, and subjecting the coated support to thermoforming for formation of an intermediate layer; and applying, to the intermediate layer, heat-sensitive recording-related components which contribute to color formation by heat, for formation of a heat-sensitive recording layer.

10 Claims, 3 Drawing Sheets

(56) References Cited

FOREIGN PATENT DOCUMENTS

| | | | |
|---|---|---|---|
| JP | 59-155097 | A | 9/1984 |
| JP | 61-274987 | | 12/1986 |
| JP | 63-299973 | A | 12/1988 |
| JP | 01-30785 | A | 2/1989 |
| JP | 4-290789 | A | 10/1992 |
| JP | 6-262857 | A | 9/1994 |
| JP | 9-39411 | A | 2/1997 |
| JP | 9-220857 | A | 8/1997 |
| JP | 2000-289338 | | 10/2000 |
| JP | 2005-307419 | | 11/2005 |
| WO | 2007-023687 | A1 | 1/2007 |

THERMAL RECORDING MATERIAL AND METHOD FOR PRODUCING THE SAME

This application is a national phase of PCT application No. PCT/JP2011/057626 filed Mar. 28, 2011, which in turn claim priority to application Nos. JP 2010-076771 filed Mar. 30, 2010, JP 2011-009865 filed Jan. 20, 2011, JP 2011-014661 filed Jan. 27, 2011 and JP 2011-019598 filed Feb. 1, 2011.

TECHNICAL FIELD

The present invention relates to a thermal recording material, namely a thermal recording material that is excellent in thermal responsiveness and particularly in quality of recorded halftone images, and a method for producing the same.

BACKGROUND ART

Generally, a thermal recording material comprises, on a support, a heat-sensitive recording layer containing, as main components, an electron-donating dye precursor, which is usually colorless or light-colored, and an electron-accepting compound. By application of heat to such a thermal recording material with a thermal head, a thermal stylus, laser beam or the like, an instant reaction between the electron-donating dye precursor and the electron-accepting compound occurs and thereby a recorded image is produced. Such a thermal recording material is advantageous, for example, in that records can be made thereon with a relatively simple device ensuring easy maintenance and no noise generation. Therefore, thermal recording materials are widely used for a measuring recorder, a facsimile, a printer, a computer terminal, a label printer, a ticket machine for passenger tickets or other tickets, and the like. Particularly in recent years, thermal recording materials are used as financial records such as receipts of gas, water, electricity and other bill payments, billing statements issued from ATMs at financial institutions and various receipts, thermal recording labels or tags for point of sales (POS) system, etc.

As the application of thermal recording materials becomes more diverse, not only texts but also gray scale images are printed more frequently, and thus thermal recording materials that are excellent in dot reproducibility in any print density, whether low or high, free from occurrence of partially missing print and excellent in recorded image quality are desired. With the increase in the speed of recording devices, thermal recording materials that excel in thermal responsiveness are also desired.

For improvement in recorded image quality of thermal recording materials, methods for enhancing smoothness of the heat-sensitive recording layer surface to strengthen adhesion to a thermal head have been developed. For example, Patent Literature 1 describes surface processing of a heat-sensitive recording layer to give a Bekk smoothness of 200 to 1000 seconds. Another proposed solution for improvement in recorded image quality is to produce a heat-insulating intermediate layer between a support and a heat-sensitive recording layer to enhance thermal responsiveness of thermal recording materials. For example, Patent Literature 2 describes an intermediate layer containing an oil-absorbing pigment, Patent Literature 3 describes an intermediate layer containing minute hollow spherical particles, and Patent Literature 4 describes a 3- to 200-μm-thick intermediate layer having minute hollow spaces and a void ratio of 50 to 95%. Further, methods for enhancing smoothness of the intermediate layer surface to attain uniform coating thickness of a heat-sensitive recording layer, which leads to reduction in print density nonuniformity resulting from nonuniform coating thickness of a heat-sensitive recording layer have also been developed. For example, Patent Literature describes blade coating using a coating liquid having a specific viscosity for formation of an intermediate layer, Patent Literature 6 describes producing an intermediate layer having minute hollow spaces and a Bekk smoothness of 2000 seconds or more, Patent Literature 7 describes thermal calendering of an intermediate layer having hollow resin particles, and Patent Literature 8 describes producing two or more intermediate layers and a heat-sensitive recording layer having a thickness standard deviation of a certain level or lower.

The methods as described above, for enhancing smoothness of a heat-sensitive recording layer, or for producing a heat-insulating intermediate layer and enhancing its smoothness, improve the recorded image quality, but their improving effects are still unsatisfactory. Therefore, desired are thermal recording materials that have an excellent recorded image quality with a uniform color density even in a halftone range, and a method for producing the same.

CITATION LIST

Patent Literature

Patent Literature 1: JP-B 52-20142
Patent Literature 2: JP-A 59-155097
Patent Literature 3: JP-A 59-5093
Patent Literature 4: JP-A 63-299973
Patent Literature 5: JP-A 04-290789
Patent Literature 6: JP-A 01-30785
Patent Literature 7: JP-A 06-262857
Patent Literature 8: WO 2007/023687 pamphlet

SUMMARY OF INVENTION

Technical Problem

An object of the present invention is to provide a thermal recording material that is excellent in thermal responsiveness and particularly in quality of recorded halftone images, and a method for producing the same.

Solution to Problem

As a result of intensive research, the present inventors found out that the above-mentioned problems can be solved by the following inventions.

(1) A thermal recording material comprising an intermediate layer and a heat-sensitive recording layer for color formation by heat stacked in this order onto a support, the thermal recording material being characterized in that the intermediate layer contains a bellows-shaped hollow resin and that the roughness of a surface on a color forming side is 1.0 μm or less as measured by Parker Print Surf.

(2) The thermal recording material according to the above (1), wherein the roughness of the surface on the color forming side is 0.8 μm or less as measured by Parker Print Surf.

(3) The thermal recording material according to the above (1), wherein the roughness of the surface on the color forming side is 0.7 μm or less as measured by Parker Print Surf.

(4) The thermal recording material according to any one of the above (1) to (3), wherein the support is a soft-calendered paper having a density of 0.9 to 1.1 g/cm$^3$ and a basis weight of 30 to 100 g/m$^2$.

(5) The thermal recording material according to any one of the above (1) to (4), wherein the intermediate layer contains a bellows-shaped hollow resin and an ethylene-vinyl acetate (EVA) copolymer wax.

(6) The thermal recording material according to any one of the above (1) to (5), wherein a protective layer is provided on the heat-sensitive recording layer, the protective layer containing a water-dispersible resin which has a core-shell structure consisting of a core comprising acrylonitrile as an essential component, and a shell comprising methacrylamide as an essential component; and at least one kind of water-soluble resin selected from a diacetone-modified polyvinyl alcohol, an acetoacetyl-modified polyvinyl alcohol and a carboxyl-modified polyvinyl alcohol.

(7) The thermal recording material according to the above (6), wherein the mass ratio of the core-shell structured acrylic emulsion and the modified polyvinyl alcohol is 1:5 to 2:1.

(8) A method for producing the thermal recording material according to any one of the above (1) to (5), comprising the steps of:

applying a coating liquid containing heat-expandable resin particles to a support, drying the coated support at a temperature lower than the expansion starting temperature of the heat-expandable resin particle, and subjecting the coated support to thermoforming for formation of an intermediate layer; and applying, to the intermediate layer, heat-sensitive recording-related components which contribute to color formation by heat, for formation of a heat-sensitive recording layer.

(9) A method for producing the thermal recording material according to any one of the above (1) to (5), comprising the steps of:

applying a coating liquid containing heat-expandable resin particles to a support, heating the coated support for thermal expansion, and performing calendering for formation of an intermediate layer; and applying, to the intermediate layer, heat-sensitive recording-related components which contribute to color formation by heat, for formation of a heat-sensitive recording layer.

(10) A method for producing the thermal recording material according to any one of the above (1) to (5), comprising the steps of:

applying a coating liquid containing heat-expandable resin particles to a support, performing thermal calendering for thermal expansion, and performing calendering for formation of an intermediate layer; and applying, to the intermediate layer, heat-sensitive recording-related components which contribute to color formation by heat, for formation of a heat-sensitive recording layer.

Advantageous Effects of Invention

The present invention provides a thermal recording material that is excellent in thermal responsiveness and particularly in quality of recorded halftone images, and a method for producing the same.

DESCRIPTION OF EMBODIMENTS

Hereinafter, the present invention will be described in more detail. The thermal recording material of the present invention is characterized in that an intermediate layer at least contains a bellows-shaped hollow resin and that the roughness of the surface on the color forming side is 1.0 μm or less as measured by Parker Print Surf.

For good recorded image quality, it is crucial that the color forming surface of a thermal recording material, i.e., a heat-sensitive recording layer or a protective layer provided thereon can uniformly adhere to a thermal head under pressure applied by a platen. Particularly for good quality in a halftone range (the applied energy level is low), high smoothness of coating layers and uniform thickness of a heat-sensitive recording layer alone are not enough, and it is further crucial that the applied pressure uniformly transmits to the coating layers. Otherwise, the good recorded image quality with a uniform color density cannot be expected. That is, for good recorded image quality, the smoothness and surface roughness which are measured under a lower applied pressure by a Bekk smoothness tester and a stylus type surface roughness tester, respectively, are not so essential, and it is necessary that the color forming surface has a high smoothness under a higher pressure and can uniformly adhere to a head. The roughness measured by Parker Print Surf indicates the degree of adhesion of the measurement surface to the measuring head under high pressure, and when this measurement value of the surface on the color forming side is 1.0 μm or less, the thermal head and the color forming surface of a thermal recording material can favorably adhere to each other in thermal printing, and thus the recorded image quality will be preferable. The roughness measured by Parker Print Surf is preferably 0.8 μm or less, and more preferably 0.7 μm or less. When this measurement value exceeds 1.0 μm, the degree of adhesion between the thermal head and the color forming surface of a thermal recording material is reduced, and particularly in a halftone range (the applied energy level is low), partially missing print will occur and the recorded image quality will be poor.

Hereinafter, the roughness measured by Parker Print Surf is expressed as PPS roughness. The PPS roughness used in the present invention is a value obtained by measurement using a hard backing at a clamp pressure of 2000 kPa.

Figure 1:
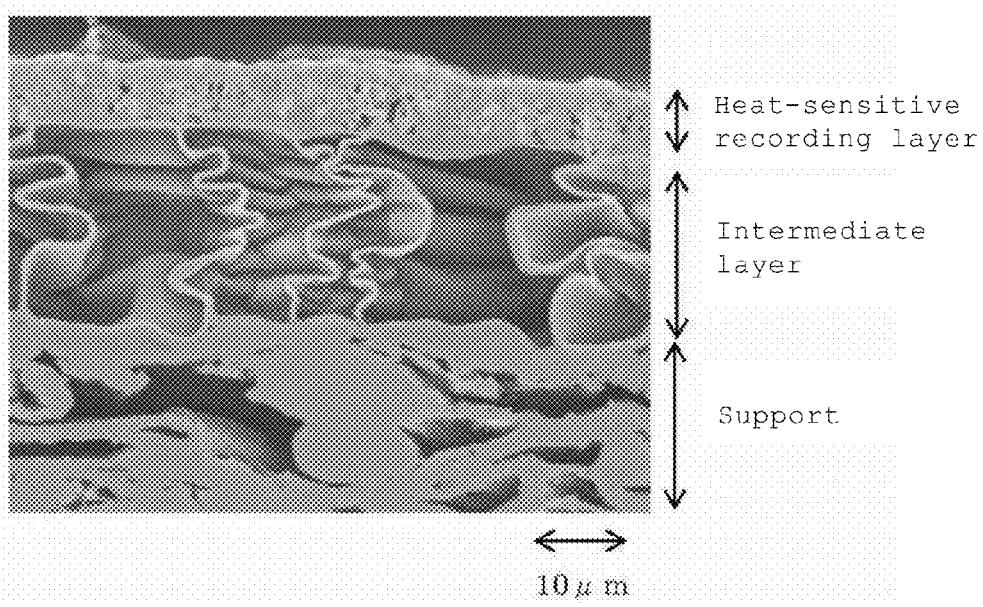
FIG. 1 is a cross-sectional view of a thermal recording material comprising an intermediate layer containing a bellows-shaped hollow resin.
Figure 3:
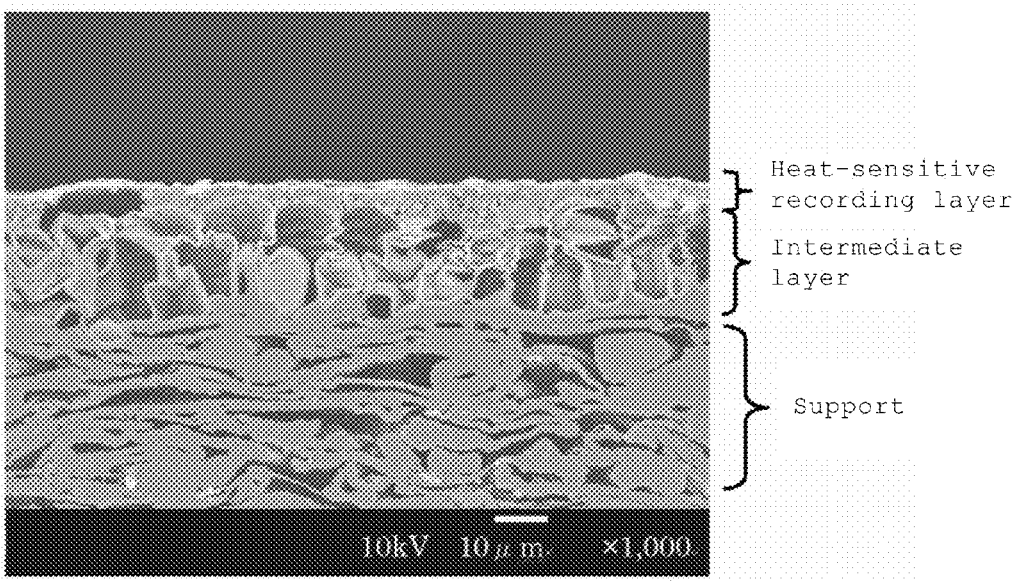
FIG. 3 is a cross-sectional view of a thermal recording material comprising an intermediate layer containing a bellows-shaped hollow resin different from the one shown in FIG. 1.

FIG. 1 shows an example of a cross-sectional view of a thermal recording material comprising an intermediate layer containing a bellows-shaped hollow resin according to the present invention. FIG. 3 shows an example of a cross-sectional view of a thermal recording material according to the present invention, the thermal recording material comprising an intermediate layer containing a bellows-shaped hollow resin different from the one shown in FIG. 1. These cross-sectional views are images each obtained by preparing a cross-section of the thermal recording material of the present invention by ion milling, and photographing the cross section under a scanning electron microscope.

Figure 2:
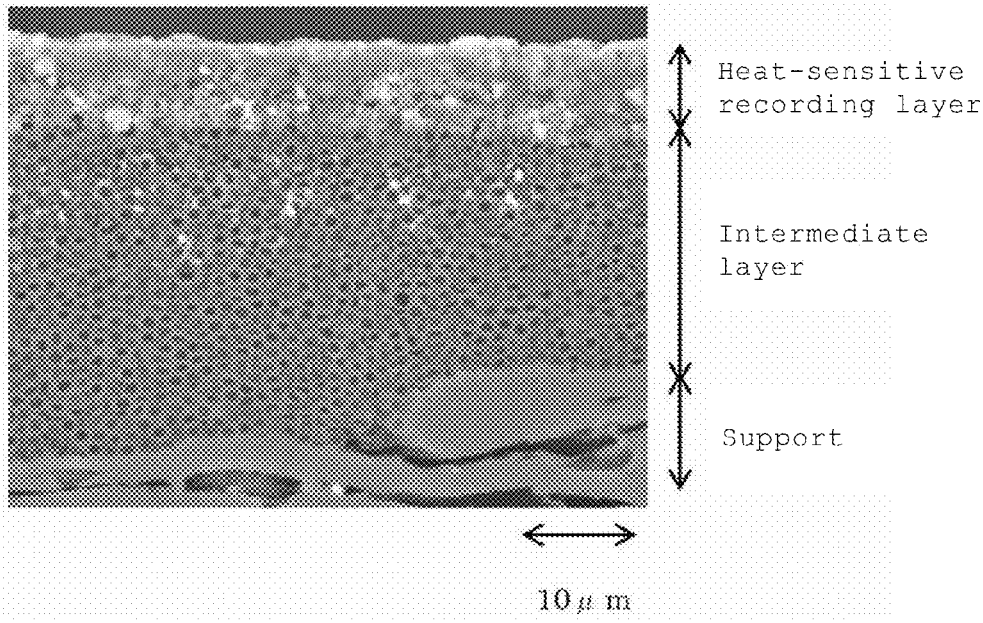
FIG. 2 is a cross-sectional view of a thermal recording material comprising an intermediate layer containing non-expanding hollow resin particles.

The bellows shape as used herein refers to, as shown in FIG. 3, a cellularly-divided structure that the hollow resin forms in the intermediate layer, and in the structure, one surface of each cell is on the support side, the opposing surface is on the heat-sensitive recording layer side, and the lateral surface has several accordion-like folds. As long as such requirements are met, the bellows-shaped hollow resin contained in the intermediate layer of the present invention may be one which forms, in the intermediate layer, a cellularly-divided structure (for example, as shown in FIG. 1) in which one surface of each cell is on the support side, the opposing surface is on the heat-sensitive recording layer side, these surfaces are located approximately in parallel, and the lateral surface has several accordion-like folds. Non-expanding hollow resin particles as shown in FIG. 2 cannot form such a bellows shape.

Figure 4:
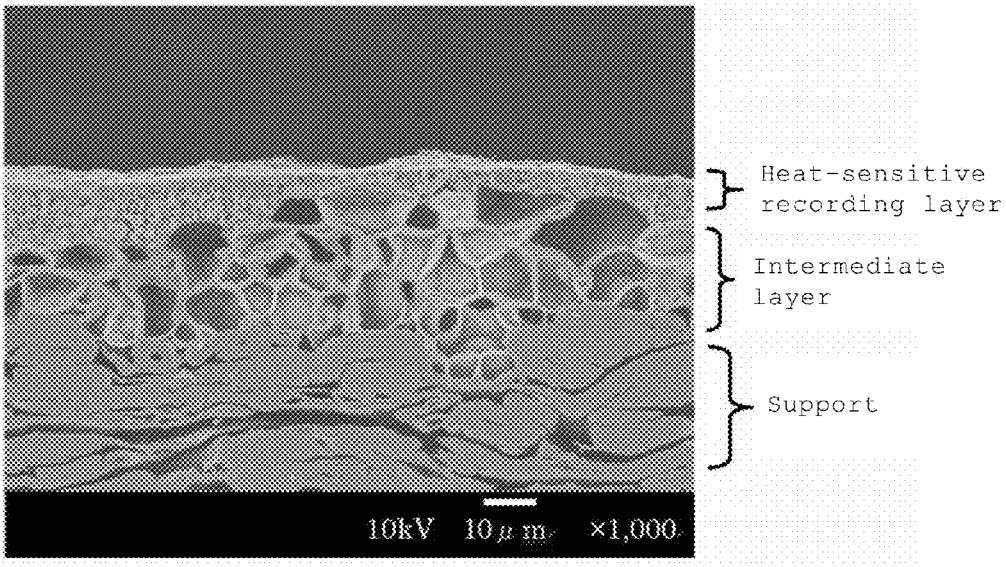
FIG. 4 is a cross-sectional view of a thermal recording material comprising an intermediate layer containing a hollow resin that is not bellows-shaped.

Due to such an accordion-like structure of the lateral surface and internal large void space, the hollow resin easily stretches and contracts in a direction perpendicular to the support under pressure, and thus can transmit a uniform pressure to the heat-sensitive recording layer. Due to such a high stretchability and hollow structure of the hollow resin, the intermediate layer of the present invention has a high elasticity and thus allows efficient adhesion of the color forming surface to a thermal head. In addition, the intermediate layer has a high heat-insulating effect due to the hollow structure. The cells may be vertically piled up in the intermediate layer, and in this case, the number of the cells piled up is preferably 1 to 5 and more preferably 1 to 3. As described above, the intermediate layer of the present invention allows the color forming surface of the thermal recording material to uniformly and favorably adhere to a thermal head under high pressure and thus contributes to favorable PPS roughness. Therefore, the thermal recording material of the present invention is free from occurrence of partially missing print even in a halftone range, is satisfactory in uniformity of recorded print density, and is excellent in thermal responsiveness in thermal printing. As shown in FIG. 4, when an intermediate layer containing a hollow resin is comprised in thermal recording materials but the hollow resin does not have a bellows shape, the effects as described above cannot be attained.

Figure 5:
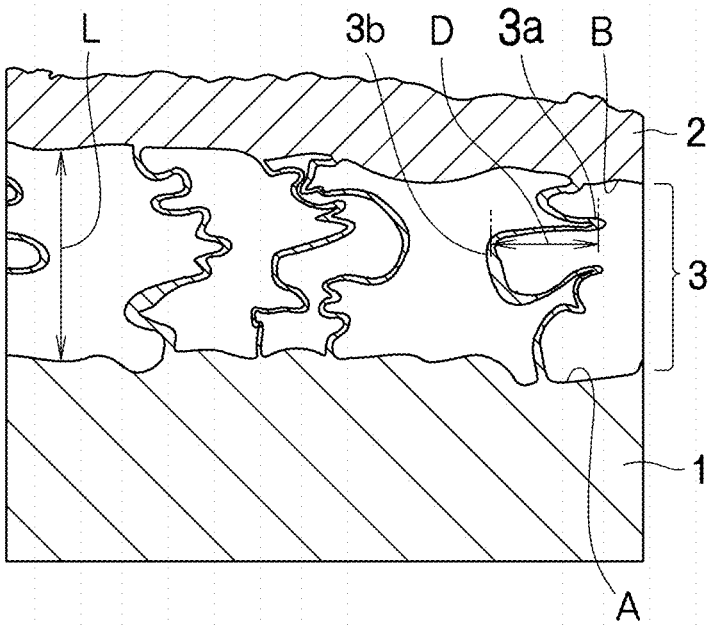
FIG. 5 is a schematic view of a cross-section of a thermal recording material for illustration of a bellows shape.

The shape of the hollow resin contained in the intermediate layer can be confirmed by observing a cross section of the thermal recording material at 1000- to 3000-fold magnification with a scanning electron microscope, an optical microscope or the like. According to the present invention, the bellows shape preferably meets the following criterion: an average fold depth in a lateral surface of a cell is no less than La×(1/15). As shown in FIG. 5, L is defined as a vertical length between a curved surface A on the support 1 side of a hollow resin-containing intermediate layer 3 and a curved surface B, which is opposed to the curved surface A and located on the heat-sensitive recording layer 2 side of the hollow resin-containing intermediate layer 3; A' and B' are defined as virtual planes by which curved surfaces A and B with a continuously-varying curvature are approximated, respectively; La is defined as the average in the length L; and the average fold depth in a lateral surface of a cell is defined as the average in half the length of a peak-to-peak distance D between folds 3*a* and 3*b*, which are adjacent to each other and protrude forward and backward along the direction parallel to virtual planes A' and B'. Each length is calculated as the average of measured values at five points arbitrarily selected in the cross-sectional view of the thermal recording material.

As the method for cross-section preparation, any method may be selected, and examples thereof include microtomy and ion milling. Particularly preferred is ion milling because this processing is least likely to cause a cross-sectional deformation.

The method for producing the intermediate layer containing a bellows-shaped hollow resin according to the present invention is not particularly limited, and examples thereof include the following. Production method A comprises the steps of: applying a coating liquid containing heat-expandable resin particles to a support, and drying the coated support at a temperature lower than the expansion starting temperature of the heat-expandable resin particle, followed by thermoforming. Production method B comprises the steps of: applying a coating liquid containing heat-expandable resin particles to a support, heating the coated support for thermal expansion, and performing calendering. Production method C comprises the steps of: applying a coating liquid containing heat-expandable resin particles to a support, performing thermal calendering for thermal expansion, and performing calendering. The thermal recording material comprising an intermediate layer formed by production method A and a heat-sensitive recording layer stacked thereon is excellent in quality of recorded halftone images and in thermal responsiveness. The thermal recording material comprising an intermediate layer formed by production method B or C and a heat-sensitive recording layer stacked thereon is excellent not only in quality of recorded halftone images and thermal responsiveness, but also in color density uniformity.

Hereinafter, production method A will be described. Production method A comprises the steps of: applying a coating liquid containing heat-expandable resin particles to a support, and drying the coated support at a temperature lower than the expansion starting temperature of the heat-expandable resin particle, followed by thermoforming. As the method for thermoforming the heat-expandable resin particles in production method A, any method may be selected. For example, heat-treatment is performed using a SCAF dryer, an IR dryer, a cylinder dryer or the like, and then pressure forming is performed using a supercalender, a thermal calender or the like. Alternatively, heat-treatment and pressure forming may be simultaneously performed using a Yankee dryer, a thermal calender, a thermal press or the like. For sufficient expansion of the particles, it is preferable that heat-treatment is performed for 1 second or longer at a temperature higher by about 10 to 100° C. than the expansion starting temperature. In the case where pressure forming is performed after heat-treatment, it is preferable that pressure forming is performed while the temperature of the coated paper surface is kept no lower than the glass transition temperature of the shell of the hollow resin. This is because, in such a condition, bellows shape formation is easier and the formed bellows shape is likely to be maintained even after release from nip pressure. In the case where heat-treatment and pressure forming are simultaneously performed, for example, both are performed using a thermal calender, the number of nips is preferably two or more for sufficient expansion of the particles and successful formation.

Next, production method B will be described. Production method B comprises the steps of: applying a coating liquid containing heat-expandable resin particles to a support, heating the coated support for thermal expansion, and performing calendering. The method for thermal expansion of the heat-expandable resin particles applied to the support in production method B is not particularly limited as long as the heating method allows the heat-expandable resin particles to sufficiently expand. For example, after applying the coating liquid containing heat-expandable resin particles, a drying step and a thermal expansion step are performed simultaneously. Alternatively, after applying the coating liquid containing heat-expandable resin particles, a drying step and a thermal expansion step may be separately performed. In production method B, it is preferable that after a drying step is performed at a temperature which does not allow the resin particles to thermally expand, a thermal expansion step is performed separately. Specific examples of the method for thermal expansion of the heat-expandable resin particles include a method using a SCAF dryer, an IR dryer, a cylinder dryer, a Yankee dryer, a thermal calender, a metal belt calender, a thermal press or the like. The heating temperature is an essential factor to allow thermal expansion of the heat-expandable resin particles, and is appropriately determined depending on the heating method. The heating temperature is determined so that it may be higher by about 10 to 100° C. than the expansion starting temperature of the heat-expandable resin particle and that the temperature of the surface of the heat-expandable resin particle coating may rise to 80 to 250° C. in general.

The method for thermal expansion of the heat-expandable resin particles in production method B is particularly preferably thermal calendering as in production method C. In thermal calendering, heating and pressurization can be performed simultaneously and thus thermal expansion of the heat-expandable resin particles and smoothing of the intermediate layer can be achieved simultaneously. By applying a coating liquid containing heat-expandable resin particles to a support, performing thermal calendering for thermal expansion, and performing calendering at ordinary temperature for formation of an intermediate layer containing a bellows-shaped hollow resin, a thermal recording material that is excellent particularly in color density uniformity can be obtained.

The thermal calendering in production method C is a method that allows thermal expansion to occur, and is performed by making the support coated with the heat-expandable resin particles feed through a nip between two metallic rolls or between a metallic roll and an elastic roll. In this method, one or both of the rolls may be heated. The linear pressure at the thermal calendering is preferably 100 to 2000 N/cm, and particularly preferably 500 to 1500 N/cm. The metallic roll is preferably an induction heated jacket roll, and the temperature of the heated roll is preferably 100 to 220° C., and particularly preferably 130 to 190° C. For further efficient thermal calendering, the following means can be employed: adjusting the wrapping angle of the coated support on the thermal roll so as to increase the contact time (contact length) of the thermal roll and the support coated with the heat-expandable resin particles in front of and/or after the nip; using three or more (multiple) rolls which form two or more nips; preheating the coated support just before thermal calendering; and combining the foregoing means. The contact time of the coated support and the thermal roll is preferably 0.1 to 10 seconds, and particularly preferably 0.3 to 3 seconds in terms of productivity and thermal expansion uniformity.

In production method B, the calendering following thermal expansion may be performed using a chilled-nip calender, a soft-nip calender, a supercalender or the like, and there is no particular limitation as long as the number of nips is one or more. The linear pressure at the calendering is not particularly limited as long as the effects of the present invention are achieved, but preferred is the range of 300 to 2000 N/cm. When the linear pressure is lower than 300 N/cm, the bellows shape is hard to be formed. When the linear pressure is higher than 2000 N/cm, resin particles tend to be deformed. The temperature of the calender roll during the calendering following thermal expansion is such that thermal expansion does not proceed any more. Specifically, the temperature is lower than the expansion starting temperature of the heat-expandable resin particle, and generally from ordinary temperature to 100° C. As long as thermal expansion does not proceed during the calendering, calendering may be performed immediately after thermal expansion, or performed after the support coated with the heat-expandable resin particles is once cooled down to ordinary temperature after thermal expansion.

The heat-expandable resin particle used for formation of the bellows-shaped hollow resin refers to a resin particle of which the diameter increases with heating. An example of such a particle is a hollow resin particle containing a volatile liquid therein. When heat is applied to the particle, the resin turns soft and the volatile liquid vaporizes (increases in volume) at the same time, resulting in particle expansion. More specifically, in such a hollow resin particle, the outer shell resin is composed of a polymer or a copolymer made of styrene monomers such as styrene and α-methylstyrene, acrylic monomers such as methyl (meth)acrylate, ethyl (meth)acrylate, isobornyl (meth)acrylate and acrylonitrile, a vinylidene chloride monomer and a vinyl acetate monomer; and the inner volatile liquid is composed of a low-boiling hydrocarbon such as propane, butane, isobutane, pentane, isopentane, hexane and heptane. According to the present invention, in terms of thermal expansion capacity and bellows shape formation, a hollow resin particle in which the outer shell resin is composed of a methyl methacrylate-acrylonitrile copolymer or a vinylidene chloride-acrylonitrile copolymer, and the volatile liquid is composed of isobutane or isopentane is particularly preferred. In addition, the outer shell resin may be crosslinked by a multifunctional monomer, and also inorganic particles such as silica may be adsorbed to the outer shell resin surface. The expansion starting temperature of the heat-expandable resin particle of the present invention is preferably in the range of 80 to 130° C.

The heat-expandable resin particle used for formation of the bellows-shaped hollow resin preferably meets the following conditions: the average particle diameter before expansion is preferably 1 to 25 μm, and more preferably 3 to 10 μm; the volume expands 10 to 50 times by heating; and the hollow ratio after heating is 80% or more. When the average particle diameter is 1 μm or larger, bellows shape formation is easier because the volume and the surface area sufficiently increases with heating, and also sufficient void space formed by heating in the particles brings about a heat-insulating effect. When the average particle diameter is 25 μm or smaller, a desired smoothness of the intermediate layer can be easily attained after the thermoforming step. The average particle diameter used herein is a volume-average particle diameter calculated based on particle size distribution measured by the laser diffraction/scattering method. When the hollow ratio after heating is 80% or more, sufficient void space formed by heating in the particles brings about a heat-insulating effect, and also bellows shape formation is easier because the outer shell becomes sufficiently thinner. The hollow ratio used herein is calculated by dividing the hollow volume by the total volume of a hollow particle.

The expansion starting temperature of the heat-expandable resin particle is preferably in the range of 80 to 130° C. When the expansion starting temperature is 80° C. or higher, due to good heat resistance of the shell, the bellows shape can be favorably maintained even while the thermal recording material of the present invention is stored for a long period. When the expansion starting temperature is 130° C. or lower, formation of the intermediate layer containing a bellows-shaped hollow resin is easily achieved.

Specific examples of the heat-expandable resin particle include commercially available products such as ADVANCELL manufactured by Sekisui Chemical Co., Ltd.; Expancel manufactured by AkzoNovel, Netherlands; Matsumoto Microsphere manufactured by Matsumoto Yushi-Seiyaku Co., Ltd.; and KUREHA Microsphere manufactured by KUREHA CORPORATION.

According to the present invention, the coating amount of the intermediate layer containing heat-expandable resin particles is preferably 2 to 30 g/m$^2$. In this case, the support is fully coated after the thermoforming step, and a desired smoothness of the intermediate layer can be easily attained. The amount of the heat-expandable resin particle is preferably 20 mass % or more, and more preferably 60 mass % or more relative to the total solid content of the intermediate layer. On the other hand, in terms of adhesive strength between the intermediate layer and the support, and the strength of the intermediate layer itself, the amount of the heat-expandable resin particle is preferably 90 mass % or less relative to the total solid content of the intermediate layer.

According to the present invention, it is more preferred that the intermediate layer contains a bellows-shaped hollow resin and an ethylene-vinyl acetate (EVA) copolymer wax. In this case, a thermal recording material that is excellent not only in quality of recorded halftone images and thermal responsiveness, but also in color density uniformity and coating layer strength can be obtained.

According to the present invention, an intermediate layer containing a bellows-shaped hollow resin is obtainable by the above-mentioned production method A, B or C. However, such a hollow resin, which has peculiar characteristics such as low specific gravity and low polarity of resin components, easily separates from binder components in a coating liquid or during coating layer formation, and thus may self-aggregate or cause uneven coating and low surface smoothness. Therefore, the bellows-shaped hollow resin may reduce color density uniformity, albeit improving the quality of recorded halftone images and thermal responsiveness.

By use of an EVA copolymer wax in combination with the hollow resin in an intermediate layer, a uniform intermediate layer can be formed and the color density uniformity can be improved. Although the accurate mechanism by which such effects are produced is unclear, one presumption is that the EVA copolymer wax adheres to the hollow resin surface and thereby inhibits hollow resin aggregation, resulting in good uniform dispersion without aggregation and thus successful coating layer formation. In addition, after coating layer formation, due to low hardness, the EVA copolymer wax presumably contributes to improvement in color density uniformity without deterioration of recorded image quality.

Another effect of the EVA copolymer wax contained in the intermediate layer, that is, improvement in coating layer strength, will be described below. An intermediate layer containing a bellows-shaped hollow resin can be formed on the support by the above-mentioned production method A, B or C. During the step of thermal expansion, thermoforming or pressure forming, the heat-sealing effect of the EVA copolymer wax contained in the intermediate layer presumably brings about adhesion between the hollow resin particles and between the hollow resin and the support, resulting in increase in intermediate layer strength and adhesive strength between the intermediate layer and the support. If polyethylene wax, paraffine, microcrystalline or the like is used instead of the EVA copolymer wax, all the functions described above are not attained.

The EVA copolymer wax refers to one which substantially has no binding effect but heat-sealing effect, and differs in properties from EVA copolymers widely used as an adhesive, which is a general usage of EVA copolymers. In the copolymer wax, the amount of the vinyl acetate unit is about 1.0 to 30 mass % relative to all the constitutional units of the copolymer, and the weight-average molecular weight and the melting point of the copolymer wax is about 1000 to 6000 and about 70 to 110° C., respectively. According to the present invention, in addition to ethylene and vinyl acetate, a monomer that can be copolymerized with the two monomers may be used. Specific examples thereof include, but are not limited to, vinyl halides such as vinyl chloride and vinyl bromide; vinylidene halides such as a vinylidene chloride; vinyl compounds such as vinyl phosphonic acid, vinyl sulfonic acid and their salts; aromatic vinyl compounds such as styrene, α-methylstyrene and chlorostyrene; (meth)acrylic acids such as methacrylic acid and acrylic acid; (meth)acrylic acid esters such as methyl (meth)acrylate, butyl (meth)acrylate and 2-ethylhexyl (meth)acrylate; α,β-unsaturated dicarboxylic acids such as maleic acid, maleic anhydride, succinic acid and itaconic acid; nitriles such as (meth)acrylonitrile; acrylamides such as N-methylolacrylamide and N-butoxymethylacrylamide; conjugated dienes such as butadiene and isoprene; and allyl compounds such as allyl sulfonate, diallyl phthalate, triallyl cyanurate and triallyl isocyanurate. The amount of such a copolymerizable monomer unit other than ethylene and vinyl acetate is preferably 25 mass % or less relative to all the constitutional units of the EVA copolymer.

The EVA copolymer wax is preferably used in the form of minute particles. Such an EVA copolymer wax can be produced by emulsion polymerization of ethylene and vinyl acetate as monomers, or by grinding a powdered or flaky wax. The average particle diameter of the EVA copolymer wax is preferably 10 μm or smaller, more preferably 4.5 μm or smaller, and even more preferably 0.5 μm or smaller. When the average particle diameter is 10 μm or smaller, improvement in color density uniformity and coating layer strength can be attained without decline in dot reproducibility in thermal color formation. When the average particle diameter is 4.5 μm or smaller, such improvement effects are greater, and when the average particle diameter is 0.5 μm or smaller, the improvement effects are the greatest and the smoothness of the intermediate layer surface is much higher. The lower limit is preferably 0.05 μm.

Exemplary commercial products of the EVA copolymer wax include, but are not limited to, water-dispersion products such as V200 among the CHEMIPEARL V series manufactured by Mitsui Chemicals, Inc., and AQUATIX8421 manufactured by BYK-Chemie, Germany; and powder products such as 400A among the A-C series manufactured by Honeywell International Inc., U.S.A.

The amount of the EVA copolymer wax, in terms of nonvolatile matter of the wax, is preferably 0.1 to 30 mass %, and more preferably 0.5 to 15 mass % relative to the heat-expandable hollow resin. When the amount is less than 0.1 mass %, the dispersion-stabilizing effect is smaller. When the amount exceeds 30 mass %, the hollow resin ratio in the intermediate layer is low and thus the color forming sensitivity may be reduced.

The intermediate layer of the present invention can contain, when necessary, various inorganic pigments, organic pigments or composite pigments of organic and inorganic constituents unless the effects of the present invention are hindered. Examples of the pigments include pigments conventionally used for coated paper etc. such as diatomite, talc, kaolin, calcined kaolin, heavy calcium carbonate, light calcium carbonate, magnesium carbonate, zinc oxide, aluminum oxide, aluminum hydroxide, magnesium hydroxide, titanium dioxide, barium sulfate, zinc sulfate, amorphous silica, calcium silicate, colloidal silica, melamine resins, urea-formaldehyde resins, polyethylene, polystyrene and ethylene-vinyl acetate. These pigments may be used alone or in a combination of two or more kinds thereof. Spherical organic particles, hollow organic particles or the like can be also used. The inorganic and organic pigment content is preferably in the range of 0 to 30 mass % relative to the heat-expandable resin particle because this range does not hinder the effects of the present invention.

The intermediate layer can contain, as a binder, various water-soluble high molecular compounds or water-dispersible resins that are conventionally used for coating. Specific examples of the binder include, but are not limited to, water-soluble resins such as starch, hydroxymethyl cellulose, methyl cellulose, ethyl cellulose, carboxymethyl cellulose, gelatin, casein, polyvinyl alcohol, a modified polyvinyl alcohol, sodium alginate, polyvinyl pyrrolidone, polyacrylamide, an acrylamide/acrylic acid ester copolymer, an acrylamide/acrylic acid ester/methacrylic acid terpolymer, an alkali salt of polyacrylic acid, an alkali salt of polymaleic acid, an alkali salt of a styrene/maleic anhydride copolymer, an alkali salt of an ethylene/maleic anhydride copolymer and an alkali salt of an isobutylene/maleic anhydride copolymer; and water-dispersible resins such as a styrene/butadiene copolymer, an acrylonitrile/butadiene copolymer, a methyl acrylate/butadiene copolymer, an acrylonitrile/butadiene/styrene terpolymer, polyvinyl acetate, a vinyl acetate/acrylic acid ester copolymer, an ethylene/vinyl acetate copolymer, polyacrylic acid ester, a styrene/acrylic acid ester copolymer and polyurethane. These binders may be used alone or as a mixture of two or more kinds thereof. The amount of the binder is preferably 10 to 400 mass % relative to the heat-expandable resin particle.

To the coating liquid for forming the intermediate layer, other additives such as pigment dispersants, fluorescence dyes, coloring dyes and pigments, ultraviolet absorbers, conductive substances, lubricants, water resistant additives, defoamants and preservatives can be added unless the effects of the present invention are hindered.

The intermediate layer can be formed according to a known technique without any particular limitation. Specific examples of the technique include air knife coating, rod blade coating, bar coating, blade coating, gravure coating, curtain coating and extrusion bar coating. According to the present invention, air knife coating or curtain coating is particularly preferred in terms of stability of the heat-expandable resin.

The heat-sensitive recording layer for color formation by heat according to the present invention is obtainable by applying, to the intermediate layer, heat-sensitive recording-related components which contribute to color formation by heat. The heat-sensitive recording-related components are not particularly limited, and any combination of components may be used as long as a color forming reaction between the components can occur when energy is applied by a thermal head. Examples of the combination include a combination of a colorless or light-colored electron-donating dye precursor and an electron-accepting compound; a combination of an aromatic isocyanate compound and an imino compound; a combination of a colorless or light-colored electron-donating dye precursor and an isocyanate compound; a combination of a metal compound and a coordination compound; and a combination of a diazonium salt and a coupler. In terms of color density, ease of color formation, ease of color forming regulation and the like, the combination of an electron-donating dye precursor, which is usually colorless or light-colored, and an electron-accepting compound; the combination of an aromatic isocyanate compound and an imino compound; or the combination of an electron-donating dye precursor, which is usually colorless or light-colored, and an isocyanate compound is preferably used.

The dye precursor used in the heat-sensitive recording layer that constitutes the heat-sensitive recording material of the present invention is typified by substances generally used in pressure-sensitive recording materials or thermal recording materials, but not limited thereto.

Specific examples of the dye precursor include, but are not limited to, the following:

(1) Triarylmethane compounds 3,3-bis(p-dimethylaminophenyl)-6-dimethylamino-phthalide (crystal violet lactone), 3,3-bis(p-dimethylaminophenyl)phthalide, 3-(p-dimethylaminophenyl)-3-(1,2-dimethylindol-3-yl)-phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylamino-phthalide, 3,3-bis(1,2-dimethylindol-3-yl)-6-dimethylamino-phthalide, 3,3-bis(9-ethylcarbazol-3-yl)-5-dimethylamino-phthalide, 3,3-bis(2-phenylindol-3-yl)-5-dimethylamino-phthalide, 3-p-dimethylaminophenyl-3-(1-methylpyrrol-2-yl)-6-dimethyl-amino-phthalide, 3,3-bis(1-n-butyl-2-methylindol-3-yl)phthalide, and the like;

(2) Diphenylmethane compounds 4,4'-bis(dimethylaminophenyl)benzhydrylbenzyl ether, N-chlorophenylleucoauramine, N-2,4,5-trichlorophenylleucoauramine, and the like;

(3) Xanthene compounds rhodamine B anilinolactam, rhodamine B-p-chloroanilinolactam, 3-diethylamino-7-dibenzylaminofluoran, 3-diethylamino-7-octylaminofluoran, 3-diethylamino-6-chloro-7-methylfluoran, 3-diethylamino-7-(3,4-dichloroanilino)fluoran, 3-diethylamino-7-(2-chloroanilino)fluoran, 3-diethylamino-6-methyl-7-anilinofluoran, 3-dibutylamino-6-methyl-7-anilinofluoran, 3-dipentylamino-6-methyl-7-anilinofluoran, 3-(N-ethyl-N-tolyl)amino-6-methyl-7-anilinofluoran, 3-piperidino-6-methyl-7-anilinofluoran, 3-(N-ethyl-N-tolyl)amino-6-methyl-7-phenethylaminofluoran, 3-di-n-butylamino-7-(2-chloroanilino)fluoran, 3-diethylamino-7-chlorofluoran, 3-diethylamino-7-bromofluoran, 3-diethylamino-7-phenoxyfluoran, 3-diethylamino-7-phenylfluoran, 3-diethylamino-7-(4-nitroanilino)fluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tetrahydrofurfuryl)amino-6-methyl-7-anilino-fluoran, and the like;

(4) Thiazine compounds benzoyl leucomethylene blue, p-nitrobenzoyl leucomethylene blue, and the like; and (5) Spiro compounds 3-methylspirodinaphthopyran, 3-ethyl spirodinaphthopyran, 3,3'-dichlorospirodinaphthopryan, 3-benzylspirodinaphthopyran, 3-methylnaphtho-(3-methoxybenzo)spiropyran, 3-propylspirobenzopyran, and the like.

If needed, these dye precursors may be used alone or as a mixture of two or more kinds thereof.

Examples of the electron-accepting compound include clay substances, phenol derivatives, aromatic carboxylic acid derivatives, N,N'-diallylthiourea derivatives and urea derivatives such as N-sulfonylurea; and metal salts of the foregoing compounds. Specific examples of the electron-accepting compound include, but are not limited to, clay substances such as acid clay, activated bleaching clay, zeolite, bentonite and kaolin, p-phenylphenol, p-hydroxyacetophenone, 4-hydroxy-4'-isopropoxy diphenylsulfone, 4-hydroa-4'-n-propoxy diphenylsulfone, 3-phenylsulfonyl-4-hydroxy diphenylsulfone, 4-hydroxy-4'-benzenesulfonyloxy diphenylsulfone, 1,1-bis(4-hydroxyphenyl)propane, 1,1-bis(4-hydroxyphenyl)pentane, 1,1-bis(4-hydroxyphenyl)hexane, 1,1-bis(4-hydroxyphenyl)cyclohexane, 1,1-bis(4-hydroxyphenyl)cyclododecane, 2,2-bis(4-hydroxyphenyl)propane, 2,2-bis(4-hydroxyphenyl)hexane, 2,2-bis(4-hydroxyphenyl)octane, 1,1-bis(4-hydroxyphenyl)-2-ethylhexane, 2,2-bis(3-chloro-4-hydroxyphenyl)propane, 1,1-bis(4-hydroxyphenyl)-1-phenylethane, 1,3-bis[2-(4-hydroxyphenyl)-2-propyl]benzene, 1,3-bis[2-(3,4-dihydroxyphenyl)-2-propyl]benzene, 1,4-bis[2-(4-hydroxyphenyl)-2-propyl]benzene, 4,4'-dihydroxydiphenyl ether, bis[4-(4-toluenesulfonyl)aminocarbonyl aminophenyl]methane, N-(2-hydroxyphenyl)benzenesulfonamide, N-(2-hydroxyphenyl)-p-toluenesulfonamide, N-(4-hydroxyphenyl)benzenesulfonamide, N-(4-hydroxyphenyl)-p-toluenesulfonamide, 4,4'-dihydroxy diphenylsulfone, 2,4'-dihydroxy diphenylsulfone, 3,3'-dichloro-4,4'-dihydroxy diphenylsulfone, 3,3'-diallyl-4,4'-dihydroxy diphenylsulfone, 4-hydroxy-4'-allyloxy diphenylsulfone, 4-hydroxy-4'-methyldiphenylsulfone, N-p-toluenesulfonyl-N'-3-(p-toluenesulfonyloxy)phenylurea, N-(4-hydroxyphenylsulfonyl)aniline, 3,3'-dichloro-4,4'-dihydroxy diphenylsulfide, methyl 2,2-bis(4-hydroxyphenyl)acetate, butyl 2,2-bis(4-hydroxyphenyl)acetate, 4,4'-thiobis(2-t-butyl-5-methylphenol), benzyl p-hydroxybenzoate, chlorobenzyl p-hydroxybenzoate, dimethyl 4-hydroxyphthalate, benzyl gallate, stearyl gallate, salicylanilide, 5-chlorosalicylanilide, a novolac phenolic resin, a modified terpene phenol resin, 3,5-di-t-butyl salicylic acid, 3,5-di-t-nonyl salicylic acid, 3,5-didodecyl salicylic acid, 3-methyl-5-t-dodecyl salicylic acid, 5-cyclohexyl salicylic acid, 3,5-bis(α,α-dimethylbenzyl)salicylic acid, 3-methyl-5-(α-methylbenzyl)salicylic acid and 4-n-octyloxy carbonyl aminosalicylic acid; and salts of the foregoing compounds with a metal such as zinc, nickel, aluminum and calcium. These compounds may be used alone or in a combination of two or more kinds thereof. The blending ratio of the dye precursor and the electron-accepting compound is appropriately determined depending on the kind and combination thereof, and the total amount of the electron-accepting compound is usually 10 to 1000 mass %, and preferably 50 to 500 mass % relative to the total amount of the dye precursor.

The aromatic isocyanate compound refers to an aromatic or heterocyclic isocyanate compound which is solid at ordinary temperature and colorless or light-colored. Specific examples thereof include, but are not limited to, 2,6-dichlorophenyl isocyanate, p-chlorophenyl isocyanate, 1,3-phenylene diisocyanate, 1,4-phenylene diisocyanate, 1,3-dimethylbenzene-4,6-diisocyanate, 1,4-dimethylbenzene-2,5-diisocyanate, 1-ethoxybenzene-2,4-diisocyanate, 2,5-dimethoxybenzene-1,4-diisocyanate, 2,5-diethoxybenzene-1,4-diisocyanate, 2,5-dibutoxybenzene-1,4-diisocyanate, azobenzene-4,4'-diisocyanate, diphenylether-4,4'-diisocyanate, naphthalene-1,4-diisocyanate, naphthalene-1,5-diisocyanate, naphthalene-2,6-diisocyanate, naphthalene-2,7-diisocyanate, 3,3'-dimethylbiphenyl-4,4'-diisocyanate, 3,3'-dimethoxy-4,4'-diisocyanate, diphenylmethane-4,4'-diisocyanate, diphenyldimethylmethane-4,4'-diisocyanate, benzophenone-3,3'-diisocyanate, fluorene-2,7-diisocyanate, anthraquinone-2,6-diisocyanate, 9-ethylcarbazole-3,6-diisocyanate, pyrene-3,8-diisocyanate, naphthalene-1,3,7-triisocyanate, biphenyl-2,4,4'-triisocyanate, 4,4',4"-triisocyanate-2,5-dimethoxy triphenylamine, p-dimethylaminophenylisocyanate and tris(4-phenylisocyanate)thiophosphate. If needed, these aromatic isocyanate compounds may be used alone or as a mixture of two or more kinds thereof.

These aromatic isocyanate compounds may be used, as appropriate, in the form of a so-called blocked isocyanate, which is a phenol, lactam or oxime adduct, or the like; in the form of a dimer of a diisocyanate, for example, 1-methylbenzene-2,4-diisocyanate; in the form of an isocyanurate, which is a trimer of a diisocyanate; or in the form of a polyisocyanate, which is a polyol adduct or the like.

The imino compound is a colorless or light-colored compound and solid at ordinary temperature. Specific examples thereof include, but are not limited to, 3-imino-4,5,6,7-tetrachloroisoindolin-1-one, 1,3-diimino-4,5,6,7-tetrachloroisoindoline, 1,3-diiminoisoindoline, 1,3-diiminobenz(f)isoindoline, 1,3-diiminonaphth (2,3-f)isoindoline, 1,3-diimino-5-nitroisoindoline, 1,3-diimino-5-phenylisoindoline, 1,3-diimino-5-methoxyisoindoline, 1,3-diimino-5-chloroisoindoline, 5-cyano-1,3-diiminoisoindoline, 5-acetamido-1,3-diiminoisoindoline, 5-(p-t-butylphenoxy)-1,3-diiminoisoindoline, 5-(p-cumylphenoxy)-1,3-diiminoisoindoline, 5-isobutoxy-1,3-diiminoisoindoline, 1,3-diimino-4,7-dimethoxyisoindoline, 4,7-diethoxy-1,3-diiminoisoindoline, 4,5,6,7-tetrabromo-1,3-diiminoisoindoline, 4,5,6,7-tetrafluoro-1,3-diiminoisoindoline, 4,5,7-trichloro-1,3-diimino-6-methylmercaptoisoindoline, 1-iminodiphenic acid imide, 1-(cyano-p-nitrophenylmethylene)-3-iminoisoindoline, 1-(cyanobenzothiazolyl-(2')-carbamoylmethylene)-3-iminoisoindoline, 1-[(cyanobenzimidazolyl-2')-methylene]-3-iminoisoindoline, 1-[(cyanobenzimidazolyl-2')-methylene]-3-imino-4,5,6,7-tetrachloroisoindoline, 1-[(cyanobenzimidazolyl-2')-methylene]-3-imino-5-methoxy-isoindoline, 1-[(1'-phenyl-3'-methyl-5-oxo)-pyrazolidene-4]-3-imino-isoindoline, 3-imino-1-sulfobenzoic acid imide, 3-imino-1-sulfo-4,5,6,7-tetrachlorobenzoic acid imide, 3-imino-1-sulfo-4,5,7-trichloro-6-methylmercaptobenzoic acid imide and 3-imino-2-methyl-4,5,6,7-tetrachloroisoindolin-1-one. If needed, these imino compounds may be used alone or as a mixture of two or more kinds thereof.

The heat-sensitive recording layer that constitutes the thermal recording material of the present invention can contain a heat-fusible compound for improvement in thermal responsiveness. The heat-fusible compound to be used for this purpose has a melting point of preferably 60 to 180° C., and particularly preferably 80 to 140° C.

Specific examples thereof include known heat-fusible substances such as stearamide, N-hydroxymethyl stearamide, N-stearyl stearamide, ethylenebis(stearamide), N-stearyl urea, benzyl-2-naphthyl ether, m-terphenyl, 4-benzylbiphenyl, 4-acetylbiphenyl, 2,2'-bis(4-methoxyphenoxy)diethyl ether, α,α'-diphenoxyxylene, 1,2-diphenoxyethane, 1,2-bis(3-methylphenoxy)ethane, bis(4-methoxyphenyl)ether, diphenyl adipate, dibenzyl oxalate, bis(4-methylbenzyl)oxalate, bis(4-chlorobenzyl) oxalate, dimethyl terephthalate, dibenzyl terephthalate, phenyl benzenesulfonate, bis(4-allyloxyphenyl)sulfone, 4-acetylacetophenone, acetoacetanilides and fatty acid anilides. These compounds may be used alone or in a combination of two or more kinds thereof.

The amount of the heat-fusible compound is preferably 30 to 200 mass %, and more preferably 50 to 150 mass % in amass ratio relative to the electron-accepting compound. This range allows production of a thermal recording material having good basic properties in terms of thermal responsiveness, saturation color density of recorded images, background whiteness and the like.

The heat-sensitive recording layer can also contain a pigment. Examples of the pigment include inorganic pigments such as diatomite, talc, kaolin, calcined kaolin, heavy calcium carbonate, light calcium carbonate, magnesium carbonate, zinc oxide, aluminum oxide, aluminum hydroxide, magnesium hydroxide, titanium dioxide, barium sulfate, zinc sulfate, amorphous silica, amorphous calcium silicate and colloidal silica; and organic pigments such as a melamine resin filler, a urea-formalin resin filler, a polyethylene powder and a nylon powder.

The heat-sensitive recording layer can also contain other additives when necessary, and examples thereof include higher fatty acid metal salts such as zinc stearate and calcium stearate as well as waxes such as paraffin, oxidized paraffin, polyethylene, oxidized polyethylene, stearamide and castor wax for prevention of thermal print head wear or sticking; dispersants such as sodium dioctyl sulfosuccinate; ultraviolet absorbers such as benzophenone or benzotriazole compounds; surfactants; and fluorescent dyes.

The heat-sensitive recording layer can contain, as a binder, various water-soluble high molecular compounds or water-dispersible resins that are conventionally used for coating. Specific examples of the binder can be those described in the examples of the binder used in the intermediate layer. These binders may be used alone or as a mixture of two or more kinds thereof.

The coating amount of the heat-sensitive recording layer is usually in the range of 0.1 to 2.0 g/m$^2$ in terms of the dye precursor, which is suitable for sufficient thermal responsiveness, and the range of 0.15 to 1.5 g/m$^2$ is more preferred.

The thermal recording material of the present invention can comprise one or more protective layers on the heat-sensitive recording layer for the purpose of improvement in resistance to water, chemicals and plasticizers, and of prevention of color development caused by scratching or the like (background color development caused by frictional heat). It is particularly preferred that the protective layer contains a water-dispersible resin which has a core-shell structure consisting of a core comprising acrylonitrile as an essential component, and a shell comprising methacrylamide as an essential component; and at least one kind of water-soluble resin selected from a diacetone-modified polyvinyl alcohol, an acetoacetyl-modified polyvinyl alcohol and a carboxyl-modified polyvinyl alcohol. In this case, a thermal recording material that is excellent not only in quality of recorded halftone images and thermal responsiveness, but also in color density uniformity, anti-sticking property and chemical resistance can be obtained.

According to the present invention, the water-dispersible resin which has a core-shell structure consisting of a core comprising acrylonitrile as an essential component, and a shell comprising methacrylamide as an essential component (hereinafter referred to as a core-shell structured acrylic emulsion) can be generally prepared by seeded emulsion polymerization. In the seeded emulsion polymerization, an emulsion of acrylonitrile is used as a seed, and a monomer which forms a polymer having different properties, in this case, methacrylamide is added thereto as an essential component, thereby initiating polymerization. Examples of a monomer that can form a shell together with methacrylamide include acrylonitrile, styrene, acrylic acid esters such as ethyl acrylate, butyl acrylate, diethylene glycol acrylate and 2-ethylhexyl acrylate, methacrylic acid esters such as allyl methacrylate, methyl methacrylate, ethyl methacrylate and butyl methacrylate, and methacrylic acid. Such a core-shell structured acrylic emulsion may be a commercial product, for example, one marketed under the trade name of BM-1000, OM-1050 or the like from Mitsui Chemicals, Inc.

The core-shell structured acrylic emulsion contributes to a plurality of excellent functions as follows. One is high coating strength resulting from a membrane structure of the core, and another is anti-sticking property resulting from excellent heat resistance of the shell. However, in the case where the intermediate layer contains a hollow resin and such a core-shell structured acrylic emulsion is the only resin component in the protective layer, the protective layer has anti-sticking property, but is prone to distortion because of difference in layer hardness between a soft intermediate layer and a hard protective layer, and thus is prone to crack generation. Such crack generation tends to reduce chemical resistance (chemical barrier property), which is a function that the core-shell structured acrylic emulsion is supposed to contribute to.

By a combined use of at least one kind of water-soluble resin selected from a diacetone-modified polyvinyl alcohol, an acetoacetyl-modified polyvinyl alcohol and a carboxyl-modified polyvinyl alcohol, with the water-dispersible resin, i.e., the core-shell structured acrylic emulsion in the protective layer, a hybrid resin system consisting of a water-dispersible resin and a water-soluble resin is formed therein. This hybrid system prevents crack generation in the protective layer and improves anti-sticking property of the protective layer, unlike separate use of these resins.

The above-mentioned modified polyvinyl alcohol is excellent in reactivity with various kinds of curing agents and crosslinking agents, and after reaction, is excellent in resistance to water and heat. However, using the modified polyvinyl alcohol as the only resin component of the protective layer is not effective enough for thermal recording materials in the following two points. First, heat resistance is not enough to withstand rigorous sticking caused by uniform adhesion between a thermal head and the thermal recording surface of the thermal recording material comprising a hollow resin-containing intermediate layer. Second, a coating liquid for forming the protective layer has a poor leveling property, which may cause print density nonuniformity in color formation. These problems can be solved by a combined use of the modified polyvinyl alcohol with the core-shell structured acrylic emulsion.

The diacetone-modified polyvinyl alcohol is a partially- or fully-saponified copolymer of a diacetone group-containing monomer and vinyl acetate, and is obtainable by, for example, saponifying a copolymer of a diacetone group-containing monomer and vinyl acetate.

The acetoacetyl-modified polyvinyl alcohol is a partially- or fully-saponified polyvinyl alcohol having an acetoacetyl group introduced in the side chain, and is obtainable by, for example, by addition reaction of a solution, dispersion or powder of polyvinyl alcohol with a liquid or gaseous diketene.

The carboxyl-modified polyvinyl alcohol is a partially- or fully-saponified copolymer of a carboxyl group-containing monomer and vinyl acetate, and is obtainable by, for example, polymerizing vinyl acetate in the presence of a chain transfer agent such as aldehydes and ketones, saponifying the resulting polymer and then adding sodium acetate to the resulting carbonyl group-containing polyvinyl alcohol in the atmosphere of a specific oxygen concentration, followed by heat treatment; is obtainable by saponifying a copolymer of an ethylenically unsaturated dicarboxylic acid, such as maleic acid, fumaric acid, itaconic acid, crotonic acid, acrylic acid and methacrylic acid, and vinyl acetate; or is obtainable as a product of a reaction of a polyvalent carboxylic acid, such as fumaric acid, phthalic anhydride, mellitic anhydride and itaconic anhydride, with polyvinyl alcohol, or as an esterified compound of the reaction product.

Into the modified polyvinyl alcohol, another modifying group can be introduced if needed unless the effects of the present invention are hindered. Such an introduction can be performed by, for example, copolymerizing vinyl acetate with a monomer containing another modifying group to be introduced. Examples of the monomer that can be copolymerized with vinyl acetate include α-olefins such as ethylene and propylene; olefin sulfonic acids such as (meth)allylsulfonic acid, ethylene sulfonic acid and sulfonic acid maleate; alkali salts of an olefin sulfonic acid such as sodium (meth) allylsulfonate, sodium ethylene sulfonate, sodium sulfonate (meth)acrylate, sodium sulfonate (monoalkyl maleate) and sodium disulfonate alkyl maleate; amide group-containing monomers such as N-methylolacrylamide and an alkali salt of acrylamide alkylsulfonic acid; and N-vinylpyrrolidone derivatives.

The polymerization degree, the saponification degree and the modification degree of the modified polyvinyl alcohol are not particularly limited. However, in view of solubility, ease of coating, water resistance of the coat, layer strength and the like, the polymerization degree is usually 300 to 4000, preferably 500 to 3000; the saponification degree is usually 80% or higher, more preferably 90% or higher; and the modification degree is usually about 0.1 to 20 mol %, more preferably 0.5 to 10 mol %.

The total amount of the core-shell structured acrylic emulsion and the modified polyvinyl alcohol in the protective layer is preferably 5 to 90 mass %, and more preferably 15 to 75 mass % relative to the total solid content of the protective layer. The blending ratio of the core-shell structured acrylic emulsion and the modified polyvinyl alcohol is preferably 1:9 to 7:3, and more preferably 1:5 to 2:1 in a mass ratio.

In the protective layer, various curing agents and crosslinking agents can be used alone or in an appropriate combination of two or more kinds thereof, for improvement in water resistance of the core-shell structured acrylic emulsion and the modified polyvinyl alcohol. A layer containing a curing agent and/or a crosslinking agent may be a protective layer or a heat-sensitive recording layer adjacent to the protective layer. Specific examples of the curing agent and/or the crosslinking agent include the following, but are not limited thereto in the present invention:

polyvalent carboxylic acid hydrazide compounds such as adipic acid dihydrazide, isophthalic acid dihydrazide, terephthalic acid dihydrazide, dodecanedioic acid dihydrazide, oxalic acid dihydrazide, malonic acid dihydrazide, succinic acid dihydrazide, glutaric acid dihydrazide, sebacic acid dihydrazide, maleic acid dihydrazide, fumaric acid dihydrazide, itaconic acid dihydrazide and polyacrylic acid hydrazide, compounds having an epichlorohydrin residue such as a polyamide-polyamine-epichlorohydrin resin and a polyamine-epichlorohydrin resin, mono-aldehyde compounds such as formaldehyde, acetaldehyde, 2,2-dimethoxyacetaldehyde, 2,2-diethoxyacetaldehyde, 2-methoxy-2-ethoxyacetaldehyde, 2,2-dipropoxyacetaldehyde, 2,2-dibutoxyacetaldehyde, 2,2-dipentoxyacetaldehyde, 2,2-dihexoxyacetaldehyde and benzyloxy acetaldehyde, polyvalent aldehyde compounds such as glyoxal, glutaraldehyde and dialdehyde, a urea resin, a polyamide resin, a polyamine resin, a polyamide urea resin, a melamine resin, methylol compounds such as a phenol resin, epoxy compounds such as a polyfunctional epoxy resin, an isocyanate compound, a blocked isocyanate compound, persulfates such as ammonium persulfate and sodium persulfate, ferric chloride, ammonium chloride, oxidizers such as peroxides, an oxazoline compound, an aziridine compound, salts of a polyvalent metal such as Al, Ti, Zr and Mg, glyoxylates such as calcium glyoxylate and sodium glyoxylate, boric acid and borax.

The total amount of the curing agent and the crosslinking agent used in the protective layer is appropriately determined depending on the kind and combination thereof based on the total amount of the core-shell structured acrylic emulsion and the modified polyvinyl alcohol, but is preferably 0.5 to 40 mass %, and more preferably 3 to 30 mass % relative to the total amount of the core-shell structured acrylic emulsion and the modified polyvinyl alcohol.

According to the present invention, in combination with the core-shell structured acrylic emulsion and the modified polyvinyl alcohol, an additional binder can be also used in the protective layer for the purpose of, for example, viscosity control of a coating liquid for forming the protective layer. Specific examples of the additional binder can be those described in the examples of the binder used in the intermediate layer. These binders may be used alone or as a mixture of two or more kinds thereof. The amount of the additional binder is preferably 20 mass % or less, and more preferably 10 mass % or less relative to the total amount of the core-shell structured acrylic emulsion and the modified polyvinyl alcohol.

According to the present invention, the protective layer contains a pigment for improvement in writability and printer feedability. Specific examples of the pigment include, but are not limited to, inorganic pigments such as diatomite, talc, kaolin, calcined kaolin, heavy calcium carbonate, light calcium carbonate, magnesium carbonate, zinc oxide, aluminum oxide, aluminum hydroxide, magnesium hydroxide, titanium dioxide, barium sulfate, zinc sulfate, amorphous silica, amorphous calcium silicate and colloidal silica; and organic pigments such as a melamine resin filler, a urea-formalin resin filler, a polyethylene powder, a silicone powder and a nylon powder. These pigments may be used alone or as a mixture of two or more kinds thereof.

The protective layer can also contain other additives when necessary, and examples thereof include higher fatty acid metal salts such as zinc stearate and calcium stearate as well as waxes such as paraffin, oxidized paraffin, polyethylene, oxidized polyethylene, stearamide and castor wax for prevention of print head wear or sticking; dispersants such as sodium dioctyl sulfosuccinate; wetting agents; defoamants; fluorescent dyes; and ultraviolet absorbers.

According to the present invention, the protective layer may be a monolayer, or be composed of two or more layers. The coating amount of the protective layer is preferably in the range of 1 to 5 $g/m^2$. When the coating amount is less than 1 $g/m^2$, various functions which the protective layer is supposed to have cannot be attained. When the coating amount is more than 5 $g/m^2$, the loss in thermal energy transmitted from a thermal head to the heat-sensitive recording layer is greater, resulting in possible deterioration in thermal color formation.

The heat-sensitive recording layer and the protective layer can be formed according to a known technique without any particular limitation. Specifically, for example, a coating liquid is applied by a technique selected from air knife coating, rod blade coating, bar coating, blade coating, gravure coating, curtain coating, extrusion bar coating and the like, and then dried to give the heat-sensitive recording layer or the protective layer.

Alternatively, each layer may be formed by use of, for example, various printers such as a lithographic printer, a letterpress printer, a flexographic printer, a gravure printer and a screen printer.

In the thermal recording material of the present invention, a protective layer (barrier), an adhesive layer or an optional information recording layer such as a magnetic recording layer and an inkjet recording layer can be provided on the back side of the support if needed. It is also possible to perform a smoothing processing such as supercalendering after each coating liquid is applied.

The support that the thermal recording material of the present invention comprises may be transparent, semi-transparent or opaque. As the support, any material selected from paper, various nonwoven cloths, a woven cloth, a synthetic resin film, a synthetic resin laminated paper, a synthetic paper, a metallic foil, a ceramic paper, a glass plate, etc. and a composite sheet made of any combination of the foregoing materials can be used depending on the purpose. Particularly, by use of a soft-calendered paper having a density of 0.9 to 1.1 g/cm$^3$ and a basis weight of 30 to 100 g/m$^2$ as the support of the present invention, the high recorded image quality, which is a feature of the present invention, can be further enhanced.

Soft calendering reduces unevenness of the support surface and improves coatability of a coating liquid for forming the intermediate layer, and thus formation of the intermediate layer of the present invention is easily achieved. Further, soft calendering provides a support with a higher density and a basis weight of a certain value or smaller. Such a support is resistant to compression under pressure applied in pressure forming and thus sufficient pressure transmits to the intermediate layer. Therefore, formation of the intermediate layer containing a bellows-shaped hollow resin according to the present invention is easily achieved. Furthermore, such a support having a higher density is less prone to density non-uniformity inside the support. Therefore, by use of a soft-calendered paper having a density of 0.9 to 1.1 g/cm$^3$ and a basis weight of 30 to 100 g/m$^2$, a thermal recording material that is particularly excellent in quality of recorded halftone images can be obtained.

The soft calendering may be performed before size pressing of the support, or after a drying step following the size pressing. Particularly, by use of a soft calender composed of a heated metallic roll and an elastic roll, unevenness of the support surface can be efficiently reduced without any loss of features required of the support, such as stiffness. It is preferable that the linear pressure at the soft calendering is preferably about 1500 to 2500 N/cm and that the processing temperature is about 80 to 250° C. This is because these conditions make it easy to attain desired features. The Bekk smoothness after the soft calendering is preferably 150 seconds or more for improvement in coatability of a coating liquid for forming the intermediate layer.

EXAMPLES

Hereinafter, the present invention will be illustrated by Examples, but is not limited thereto. In the Examples, "parts" and "%" are each on the mass basis, and the coating amount denotes the bone-dry coating amount.

Example 1

(1) Preparation of Support Having Intermediate Layer

First, 100 parts of a heat-expandable resin particle, Expancel 053-40DU (manufactured by AkzoNovel, average particle diameter before thermal expansion: 10 to 16 μm, expansion starting temperature: 96 to 103° C., expansion ratio: about 50 fold) was dispersed in 200 parts of a 10% aqueous polyvinyl alcohol solution. To a high-quality paper having a density of 0.8 g/cm$^3$ and a basis weight of 120 g/m$^2$, which had not been subjected to soft calendering, the prepared dispersion was applied so that the solid coating amount might be 10 g/m$^2$. Next, drying was performed while the temperature of the coated paper surface was kept no higher than 80° C. Then, thermoforming was performed using a 3-roll thermal calender having two nips formed by three vertically stacked rolls with a diameter of 500 mm. The conditions were as follows: the linear pressure was 500 N/cm, the processing temperature was 150° C., the processing speed was 40 m/min, and the contact time of the coating surface and the thermal roll was about 1 second. Thus, a support having an intermediate layer was obtained.

(2) Preparation of Coating Liquid for Forming Heat-Sensitive Recording Layer <Dispersion A1>

In 70 parts of a 2.5% aqueous polyvinyl alcohol solution, 30 parts of 3-dibutylamino-6-methyl-7-anilinofluoran was dispersed and then ground by a bead mill until the volume-average particle diameter became 0.8 μm. Thus, dispersion A1 was prepared.

<Dispersion B1>

In 70 parts of a 2.5% aqueous polyvinyl alcohol solution, parts of 4-hydroxy-4'-isopropoxy diphenylsulfone was dispersed and then ground by a bead mill until the volume-average particle diameter became 0.7 μm. Thus, dispersion B1 was prepared.

<Dispersion C1>

In 70 parts of a 2.5% aqueous polyvinyl alcohol solution, 30 parts of benzyl-2-naphthyl ether was dispersed and then ground by a bead mill until the volume-average particle diameter became 0.8 μm. Thus, dispersion C1 was prepared.

These dispersions were mixed in the following blending ratio and stirred well to give coating liquid 1 for forming a heat-sensitive recording layer.

[Coating Liquid 1 for Forming a Heat-Sensitive Recording Layer]

| | |
|---|---|
| Dispersion A1 | 100 parts |
| Dispersion B1 | 100 parts |
| Dispersion C1 | 100 parts |
| 10% Aqueous polyvinyl alcohol solution | 200 parts |
| 30% Aqueous dispersion of light calcium carbonate | 100 parts |
| 40% Aqueous zinc stearate dispersion | 25 parts |
| Water | 60 parts |

(3) Production of Thermal Recording Material

To the support having an intermediate layer, which was prepared in the above (1), coating liquid 1 for forming a heat-sensitive recording layer was applied so that the coating amount might be 0.5 g/m$^2$ in terms of a dye precursor, and then calendering was performed. Thus, a thermal recording material was produced.

Example 2

The same procedures as described in Example 1 were performed to give a thermal recording material, except for using 100 parts of a heat-expandable resin particle, Expancel 461-20DU (manufactured by AkzoNovel, average particle diameter before thermal expansion: 6 to 9 μm, expansion starting temperature: 100 to 106° C., expansion ratio: about 35 fold) instead of 100 parts of the heat-expandable resin particle Expancel 053-40DU in the preparation of a support having an intermediate layer.

Example 3

The same procedures as described in Example 1 were performed to give a thermal recording material, except that the thermoforming was performed under the following conditions: the linear pressure was 1000 N/cm, the processing speed was 20 m/min, and the contact time of the coating surface and the thermal roll was about 2 seconds in the preparation of a support having an intermediate layer.

Example 4

The same procedures as described in Example 1 were performed to give a thermal recording material, except that a high-quality paper having a density of 0.8 g/cm$^3$ and a basis weight of 50 g/m$^2$ was used as a support and that the thermoforming was performed under the following conditions: the linear pressure was 1000 N/cm, the processing speed was 20 m/min, and the contact time of the coating surface and the thermal roll was about 2 seconds in the preparation of a support having an intermediate layer.

Example 5

The same procedures as described in Example 1 were performed to give a thermal recording material, except that a high-quality paper having a density of 1.0 g/cm$^3$ and a basis weight of 120 g/m$^2$ was used as a support and that the thermoforming was performed under the following conditions: the linear pressure was 1000 N/cm, the processing speed was 20 m/min, and the contact time of the coating surface and the thermal roll was about 2 seconds in the preparation of a support having an intermediate layer.

Example 6

The same procedures as described in Example 1 were performed to give a thermal recording material, except that a high-quality paper having a density of 1.0 g/cm$^3$ and a basis weight of 50 g/m$^2$ was used as a support and that the thermoforming was performed under the following conditions: the linear pressure was 1000 N/cm, the processing speed was 20 m/min, and the contact time of the coating surface and the thermal roll was about 2 seconds in the preparation of a support having an intermediate layer.

Example 7

The same procedures as described in Example 1 were performed to give a thermal recording material, except that a high-quality paper having a density of 0.9 g/cm$^3$ and a basis weight of 30 g/m$^2$ was subjected to soft calendering at a linear pressure of 2000 N/cm and at a processing temperature of 150° C. and then used as a support and that the thermoforming was performed under the following conditions: the linear pressure was 1000 N/cm, the processing speed was 20 m/min, and the contact time of the coating surface and the thermal roll was about 2 seconds in the preparation of a support having an intermediate layer.

Example 8

The same procedures as described in Example 1 were performed to give a thermal recording material, except that a high-quality paper having a density of 1.1 g/cm$^3$ and a basis weight of 100 g/m$^2$ was subjected to soft calendering at a linear pressure of 2000 N/cm and at a processing temperature of 150° C. and then used as a support and that the thermoforming was performed under the following conditions: the linear pressure was 1000 N/cm, the processing speed was 20 m/min, and the contact time of the coating surface and the thermal roll was about 2 seconds in the preparation of a support having an intermediate layer.

Comparative Example 1

The same procedures as described in Example 1 were performed to give a thermal recording material, except for dispersing 20 parts of the heat-expandable resin particle Expancel 053-40DU together with 80 parts of calcined kaolin (manufactured by Nord Kaolin Company, trade name: Norcal) instead of 100 parts of Expancel 053-40DU in the preparation of a support having an intermediate layer.

Comparative Example 2

The same procedures as described in Example 1 were performed to give a thermal recording material, except that the drying was performed while the temperature of the coated paper surface was kept at 130° C. to allow the heat-expandable resin particle to expand and that the subsequent thermal calendering was not performed in the preparation of a support having an intermediate layer.

Comparative Example 3

The same procedures as described in Example 1 were performed to give a thermal recording material, except that the thermoforming was performed under the following conditions: the linear pressure was 1000 N/cm, the processing temperature was 90° C., the processing speed was 20 m/min, and the contact time of the coating surface and the thermal roll was about 2 seconds in the preparation of a support having an intermediate layer.

Comparative Example 4

The same procedures as described in Example 1 were performed to give a thermal recording material, except that 100 parts of a non-expanding hollow resin particle, HP-91 (manufactured by Rohm and Haas Company Japan, average particle diameter: 1.0 μm, hollow ratio: 50%) was used instead of 100 parts of the heat-expandable resin particle Expancel 053-40DU and that the thermal calendering following drying was not performed in the preparation of a support having an intermediate layer.

Comparative Example 5

The same procedures as described in Example 1 were performed to give a thermal recording material, except that 100 parts of a non-expanding hollow resin particle, HP-91 (manufactured by Rohm and Haas Company Japan, average particle diameter: 1.0 μm, hollow ratio: 50%) was used instead of 100 parts of the heat-expandable resin particle Expancel 053-40DU and that the thermoforming was performed under the following conditions: the linear pressure was 1000 N/cm, the processing speed was 20 m/min, and the contact time of the coating surface and the thermal roll was about 2 seconds in the preparation of a support having an intermediate layer.

Comparative Example 6

The same procedures as described in Example 1 were performed to give a thermal recording material, except that a high-quality paper having a density of 1.0 g/cm$^3$ and a basis weight of 50 g/m$^2$ was subjected to soft calendering at a linear pressure of 2000 N/cm and at a processing temperature of 150° C. and then used as a support, that 100 parts of a non-expanding hollow resin particle, HP-91 (manufactured by Rohm and Haas Company Japan, average particle diameter: 1.0 μm, hollow ratio: 50%) was used instead of 100 parts of the heat-expandable resin particle Expancel 053-40DU, and that the thermoforming was performed under the following conditions: the linear pressure was 1000 N/cm, the processing speed was 20 m/min, and the contact time of the coating surface and the thermal roll was about 2 seconds in the preparation of a support having an intermediate layer.

Comparative Example 7

The same procedures as described in Example 1 were performed to give a thermal recording material, except that 100 parts of a high-density spherical particle, V1004 (manufactured by ZEON Corporation, average particle diameter: 0.3 μm) was used instead of 100 parts of the heat-expandable resin particle Expancel 053-40DU and that the thermal calendering following drying was not performed in the preparation of a support having an intermediate layer.

The thermal recording materials produced in Examples 1 to 8 and Comparative Examples 1 to 7 were evaluated as below. The results are shown in Table 1.

[Confirmation of Bellows Shape]

Cross-section preparation of the thermal recording materials produced in Examples 1 to 8 and Comparative Examples 1 to 7 was performed by ion milling, and the resulting cross sections were observed at 1500-fold magnification with the scanning electron microscope S-2300 manufactured by Hitachi, Ltd. for confirmation of a bellows shape. In the case where a bellows shape was confirmed, the ratio of Da/2 to La, i.e., (Da/2)/La was determined. As previously described with reference to FIG. 5, L is defined as a vertical length between a curved surface A on the support 1 side of a hollow resin-containing intermediate layer 3 and a curved surface B, which is opposed to the curved surface A and located on the heat-sensitive recording layer 2 side of the hollow resin-containing intermediate layer 3; A' and B' are defined as virtual planes by which curved surfaces A and B with a continuously-varying curvature are approximated, respectively; La is defined as the average in the length L; and the average fold depth in a lateral surface of a cell is defined as a half (Da/2) of the average (Da) in a peak-to-peak distance D between folds 3*a* and 3*b*, which are adjacent to each other and protrude forward and backward along the direction parallel to virtual planes A' and B'. For reference, a cross-sectional view of the thermal recording material produced in Comparative Example 4 is shown in FIG. 2. This thermal recording material comprises an intermediate layer containing non-expanding hollow resin particles.

[PPS Roughness Test]

The color forming surface of each of the thermal recording materials produced in Examples 1 to 8 and Comparative Examples 1 to 7 was measured for roughness with the roughness tester Parker Print Surf manufactured by TESTING MACHINES INC., U.S.A.

[Recorded Image Quality Test]

On each of the thermal recording materials produced in Examples 1 to 8 and Comparative Examples 1 to 7, printing was performed using the printing tester TH-PMD manufactured by Okura Engineering Co., LTD. The tester was equipped with a thermal head featuring a dot density of 8 dots/mm and a head resistance of 1685Ω, and text printing was performed at an applied voltage of 21V and at applied pulse-widths of 0.2, 0.4 and 0.6 msec. The text print quality was visually evaluated. The evaluation criteria used are as follows.

A: Almost free from defective print and the recorded print density is uniform.

B: Defective print is slightly observed, but practically acceptable.

C: Defective print is observed and the recorded print density is not uniform.

D: Extensive, defective print is observed and makes it difficult to read texts.

[Thermal Responsiveness Test]

On each of the thermal recording materials produced in Examples 1 to 8 and Comparative Examples 1 to 7, printing was performed using the printing tester TH-PMD manufactured by Okura Engineering Co., LTD. The tester was equipped with a thermal head featuring a dot density of 8 dots/mm and a head resistance of 1685Ω, and solid printing was performed at an applied voltage of 21V and at applied pulse-widths of 0.6 and 1.0 msec. The print density of the solid image was measured by the reflection densitometer model RD-19 manufactured by GretagMacbeth. The evaluation criteria used are as follows.

A: The print density is 1.2 or more.

B: The print density is 1.0 or more but less than 1.2.

C: The print density is 0.5 or more but less than 1.0.

D: The print density is less than 0.5.

TABLE 1

| | Bellows shape | Average fold | PPS roughness | Recorded image quality [msec] | | | Thermal responsiveness [msec] | |
|---|---|---|---|---|---|---|---|---|
| | formation | depth | [μm] | 0.2 | 0.4 | 0.6 | 0.6 | 1.0 |
| Ex 1 | Formed | 1/15 | 1.0 | B | B | B | B | A |
| Ex 2 | Formed | 1/15 | 0.9 | B | B | B | B | A |
| Ex 3 | Formed | 1/8 | 0.8 | B | B | A | B | A |
| Ex 4 | Formed | 1/8 | 0.7 | B | A | A | B | A |
| Ex 5 | Formed | 1/8 | 0.7 | B | A | A | B | A |
| Ex 6 | Formed | 1/8 | 0.6 | B | A | A | B | A |
| Ex 7 | Formed | 1/8 | 0.5 | A | A | A | B | A |
| Ex 8 | Formed | 1/8 | 0.5 | A | A | A | B | A |
| CEx 1 | Formed | 1/16 | 2.0 | D | D | C | C | B |
| CEx 2 | Not formed | — | 1.1 | C | C | B | B | B |
| CEx 3 | Not formed | — | 2.5 | D | D | D | D | C |
| CEx 4 | Not formed | — | 1.3 | D | D | C | C | A |
| CEx 5 | Not formed | — | 1.2 | D | C | C | C | A |
| CEx 6 | Not formed | — | 1.1 | C | C | C | C | A |
| CEx7 | Not formed | — | 1.8 | D | D | D | D | C |

Ex: Example
CEx: Comparative Example

These abbreviations will apply to the other Tables in this specification.

As is apparent from Table 1, the thermal recording materials of Examples 1 to 8, each of which comprises an intermediate layer containing a bellows-shaped hollow resin and has a PPS roughness of 1.0 μm or less, are excellent in quality of recorded halftone images and in thermal responsiveness, compared with the thermal recording material of Comparative Example 1, which contains a bellows-shaped hollow resin but has a PPS roughness exceeding 1.0 μm, and with the thermal recording materials of Comparative Examples 2 to 7, each of which contains no bellows-shaped hollow resins and has a PPS roughness exceeding 1.0 μm. Particularly, the thermal recording materials of Examples 7 and 8, each of which comprises, as a support, a soft-calendered paper having a density of 0.9 to 1.1 g/cm$^3$ and a basis weight of 30 to 100 g/m$^2$, are superior in recorded image quality in a low density range to those of Examples 1 to 6.

Example 9

(1) Preparation of Support Having Intermediate Layer

First, 100 parts of a heat-expandable resin particle, Expancel 461-20DU (manufactured by AkzoNovel, average particle diameter before thermal expansion: 6 to 9 μm, expansion starting temperature: 100 to 106° C., expansion ratio: about 35 fold) was dispersed in 200 parts of a 10% aqueous polyvinyl alcohol solution. To a support, i.e., a paper having a density of 1.1 g/cm$^3$ and a basis weight of 60 g/m$^2$, the prepared dispersion was applied so that the solid coating amount might be 5 g/m$^2$. Next, drying was performed while the temperature of the coated paper surface was kept no higher than 80° C. Then, the coated paper was placed in contact with a cylinder dryer at 150° C. and heated for 30 seconds, for thermal expansion of the heat-expandable resin particle. Then, calendering was performed at a linear pressure of 500 N/cm and at ordinary temperature, and thus a support having an intermediate layer was prepared.

(2) Preparation of Coating Liquid for Forming Heat-Sensitive Recording Layer <Dispersion A2>

In 70 parts of a 2.5% aqueous polyvinyl alcohol solution, 30 parts of 3-dibutylamino-6-methyl-7-anilinofluoran was dispersed and then wet ground by a bead mill until the volume-average particle diameter became 0.8 μm. Thus, dispersion A2 was prepared.

<Dispersion B2>

In 70 parts of a 2.5% aqueous polyvinyl alcohol solution, 30 parts of 4-hydroxy-4'-isopropoxy diphenylsulfone was dispersed and then ground by a bead mill until the volume-average particle diameter became 0.7 μm. Thus, dispersion B2 was prepared.

<Dispersion C2>

In 70 parts of a 2.5% aqueous polyvinyl alcohol solution, 30 parts of benzyl-2-naphthyl ether was dispersed and then ground by a bead mill until the volume-average particle diameter became 0.8 μm. Thus, dispersion C2 was prepared.

These dispersions were mixed in the following blending ratio and stirred well to give coating liquid 2 for forming a heat-sensitive recording layer.

[Coating Liquid 2 for Forming a Heat-Sensitive Recording Layer]

| | |
|---|---|
| Dispersion A2 | 100 parts |
| Dispersion B2 | 100 parts |
| Dispersion C2 | 100 parts |
| 10% Aqueous polyvinyl alcohol solution | 200 parts |
| 30% Aqueous aluminum hydroxide dispersion | 100 parts |
| 40% Aqueous zinc stearate dispersion | 25 parts |
| Water | 60 parts |

(3) Production of Thermal Recording Material

To the support having an intermediate layer, which was prepared in the above (1), coating liquid 2 for forming a heat-sensitive recording layer, which was prepared in the above (2), was applied so that the coating amount might be 0.5 g/m$^2$ in terms of a dye precursor, and then calendering was performed. Thus, a thermal recording material was produced.

Example 10

The same procedures as described in Example 9 were performed to give a thermal recording material, except that thermal expansion of the heat-expandable resin particle was achieved by using a thermal calender heated to 170° C., instead of placing the coated paper in contact with the cylinder dryer at 150° C. and heating it for 30 seconds in (1) Preparation of support having intermediate layer. The thermal calendering was performed using a 2-roll calender in which one nip is formed between two vertically stacked metallic rolls (induction heated jacket rolls) heated to 170° C. The processing conditions were as follows: the wrapping angle of the coated paper on the roll was such that the coating surface might be in contact with the thermal roll for 1 second in front of the nip, and the linear pressure was 150 N/cm.

Example 11

The same procedures as described in Example 9 were performed to give a thermal recording material, except that thermal expansion of the heat-expandable resin particle was achieved by using a thermal calender heated to 170° C., instead of placing the coated paper in contact with the cylinder dryer at 150° C. and heating it for 30 seconds in (1) Preparation of support having intermediate layer. The thermal calendering was performed using a 2-roll calender in which one nip is formed between two vertically stacked metallic rolls (induction heated jacket rolls) heated to 170° C. The processing conditions were as follows: the wrapping angle of the coated paper on the roll was such that the coating surface might be in contact with the thermal roll for 1 second in front of the nip, and the linear pressure was 700 N/cm.

Example 12

The same procedures as described in Example 9 were performed to give a thermal recording material, except for using 100 parts of a heat-expandable resin particle, Expancel 053-40DU (manufactured by AkzoNovel, average particle diameter before thermal expansion: 10 to 16 μm, expansion starting temperature: 96 to 103° C., expansion ratio: about 50 fold) instead of 100 parts of the heat-expandable resin particle Expancel 461-20DU (manufactured by AkzoNovel, average particle diameter before thermal expansion: 6 to 9 μm, expansion starting temperature: 100 to 106° C., expansion ratio: about 35 fold) in (1) Preparation of support having intermediate layer.

Comparative Example 8

The same procedures as described in Example 9 were performed to give a thermal recording material, except that the calendering at ordinary temperature was not performed in (1) Preparation of support having intermediate layer.

Comparative Example 9

The same procedures as described in Example 9 were performed to give a thermal recording material, except that thermal expansion of the heat-expandable resin particle was achieved by using a thermal calender heated to 170° C., instead of placing the coated paper in contact with the cylinder dryer at 150° C. and heating it for 30 seconds and that the subsequent calendering at ordinary temperature was not performed in (1) Preparation of support having intermediate layer. The thermal calendering was performed using a 2-roll calender in which one nip is formed between two vertically stacked metallic rolls (induction heated jacket rolls) heated to 170° C. The processing conditions were as follows: the wrapping angle of the coated paper on the roll was such that the coating surface might be in contact with the thermal roll for 1 second in front of the nip, and the linear pressure was 150 N/cm.

Comparative Example 10

The same procedures as described in Example 9 were performed to give a thermal recording material, except that the processing using a cylinder dryer for thermal expansion of the heat-expandable resin particle was not performed in (1) Preparation of support having intermediate layer.

The thermal recording materials produced in Examples 9 to 12 and Comparative Examples 8 to 10 were evaluated as below. The results are shown in Table 2.

[Bellows Shape]

Cross-section preparation of the thermal recording materials produced in Examples 9 to 12 and Comparative Examples 8 to 10 was performed by ion milling, and the resulting cross sections were observed with the scanning electron microscope S-2300 manufactured by Hitachi, Ltd. for confirmation of a bellows shape. In the case where a bellows shape was confirmed, the ratio of Da/2 to La, i.e., (Da/2)/La was determined. As previously described with reference to FIG. 5, L is defined as a vertical length between a curved surface A on the support 1 side of a hollow resin-containing intermediate layer 3 and a curved surface B, which is opposed to the curved surface A and located on the heat-sensitive recording layer 2 side of the hollow resin-containing intermediate layer 3; A' and B' are defined as virtual planes by which curved surfaces A and B with a continuously-varying curvature are approximated, respectively; La is defined as the average in the length L; and the average fold depth in a lateral surface of a cell is defined as a half (Da/2) of the average (Da) in a peak-to-peak distance D between folds 3*a* and 3*b*, which are adjacent to each other and protrude forward and backward along the direction parallel to virtual planes A' and B'. For reference, a cross-sectional view of the thermal recording material produced in Example 10 is shown in FIG. 3, and a cross-sectional view of the thermal recording material produced in Comparative Example 9 is shown in FIG. 4.

[PPS Roughness]

The color forming surface of each of the thermal recording materials produced in Examples 9 to 12 and Comparative Examples 8 to 10 was measured for roughness with the roughness tester Parker Print Surf manufactured by TESTING MACHINES INC., U.S.A.

[Recorded Image Quality]

On each of the thermal recording materials produced in Examples 9 to 12 and Comparative Examples 8 to 10, printing was performed in the same manner as in the above-mentioned recorded image quality test on the thermal recording materials produced in Examples 1 to 8 and Comparative Examples 1 to 7. The text print quality was visually evaluated. The evaluation criteria are the same as those applied to Examples 1 to 8 and Comparative Examples 1 to 7.

[Thermal Responsiveness]

On each of the thermal recording materials produced in Examples 9 to 12 and Comparative Examples 8 to 10, solid printing was performed in the same manner as in the above-mentioned thermal responsiveness test on the thermal recording materials produced in Examples 1 to 8 and Comparative Examples 1 to 7. The print density of the solid image was measured by the reflection densitometer model RD-19 manufactured by GretagMacbeth. The evaluation criteria are the same as those applied to Examples 1 to 8 and Comparative Examples 1 to 7.

[Color Density Uniformity]

On each of the thermal recording materials produced in Examples 9 to 12 and Comparative Examples 8 to 10, printing was performed using the printing tester TH-PMD manufactured by Okura Engineering Co., LTD. The tester was equipped with a thermal head featuring a dot density of 8 dots/mm and a head resistance of 1685Ω, and solid printing was performed at an applied voltage of 21 V and at an applied pulse-width of 1.6 msec. The print density nonuniformity (print mottle) of the solid image was visually evaluated. The evaluation criteria used are as follows.

A: Print density is almost uniform.

B: Print density is slightly nonuniform, but practically acceptable.

C: Print density is nonuniform.

D: Print density is markedly nonuniform.

TABLE 2

| | Bellows shape | Average fold | PPS roughness | Recorded image quality [msec] | | | Thermal responsiveness [msec] | | Color density |
|---|---|---|---|---|---|---|---|---|---|
| | formation | depth | [μm] | 0.2 | 0.4 | 0.6 | 0.6 | 1.0 | uniformity |
| Ex 9 | Formed | 1/15 | 0.9 | B | B | B | B | A | B |
| Ex 10 | Formed | 1/13 | 0.7 | B | B | A | B | A | A |
| Ex 11 | Formed | 1/10 | 0.6 | B | A | A | B | A | A |
| Ex 12 | Formed | 1/10 | 0.9 | B | B | B | B | A | B |

TABLE 2-continued

| | Bellows shape | Average fold | PPS roughness | Recorded image quality [msec] | | | Thermal responsiveness [msec] | | Color density |
|---|---|---|---|---|---|---|---|---|---|
| | formation | depth | [μm] | 0.2 | 0.4 | 0.6 | 0.6 | 1.0 | uniformity |
| CEx 8 | Not formed | — | 1.3 | D | D | C | C | B | D |
| CEx 9 | Not formed | — | 1.1 | D | C | C | C | B | C |
| CEx 10 | Not formed | — | 1.9 | D | D | D | D | C | D |

As clearly shown in Table 2, the thermal recording materials of Examples 9 to 12, each of which comprises an intermediate layer containing a bellows-shaped hollow resin and has a PPS roughness of 1.0 μm or less, the intermediate layer being formed by applying a coating liquid containing heat-expandable resin particles to a support, followed by thermal expansion and subsequent calendering, are excellent not only in quality of recorded halftone images and thermal responsiveness, but also in color density uniformity, compared with the thermal recording materials of Comparative Examples 8 and 9, each of which comprises an intermediate layer formed through a process without calendering following thermal expansion, and with the thermal recording material of Comparative Example 10, which comprises an intermediate layer formed through a process comprising calendering without thermal expansion.

Example 13

(1) Preparation of Support Having Intermediate Layer

First, 100 parts of a heat-expandable resin particle, Expancel 053-40DU (manufactured by AkzoNovel, average particle diameter before thermal expansion: 10 to 16 μm, expansion starting temperature: 96 to 103° C., expansion ratio: about 50 fold) and 20 parts of an aqueous ethylene-vinyl acetate (EVA) copolymer wax dispersion, AQUATIX8421 (manufactured by BYK-Chemie, nonvolatile content: 20%, average particle diameter: 0.1 to 0.3 μm) were dispersed in 200 parts of a 10% aqueous polyvinyl alcohol solution. To a high-quality paper having a density of 0.8 g/cm$^3$ and a basis weight of 120 g/m$^2$, the prepared dispersion was applied so that the solid coating amount might be 10 g/m$^2$. Next, drying was performed while the temperature of the coated paper surface was kept no higher than 80° C. Then, thermoforming was performed using a 3-roll thermal calender having two nips formed by three vertically stacked rolls with a diameter of 500 mm. The conditions were as follows: the linear pressure was 500 N/cm, the processing temperature was 150° C., the processing speed was 40 m/min, and the contact time of the coating surface and the thermal roll was about 1 second. Thus, a support having an intermediate layer was obtained.

(2) Preparation of Coating Liquid for Forming Heat-Sensitive Recording Layer <Dispersion A3>

In 70 parts of a 2.5% aqueous polyvinyl alcohol solution, 30 parts of 3-di-n-butylamino-6-methyl-7-anilinofluoran was dispersed and then ground by a bead mill until the volume-average particle diameter became 0.8 μm. Thus, dispersion A3 was prepared.

<Dispersion B3>

In 70 parts of a 2.5% aqueous polyvinyl alcohol solution, parts of 4-hydroxy-4'-isopropoxy diphenylsulfone was dispersed and then ground by a bead mill until the volume-average particle diameter became 0.7 μm. Thus, dispersion B3 was prepared.

<Dispersion C3>

In 70 parts of a 2.5% aqueous polyvinyl alcohol solution, 30 parts of benzyl-2-naphthyl ether was dispersed and then ground by a bead mill until the volume-average particle diameter became 0.8 μm. Thus, dispersion C3 was prepared.

These dispersions were mixed in the following blending ratio and stirred well to give coating liquid 3 for forming a heat-sensitive recording layer.

[Coating Liquid 3 for Forming a Heat-Sensitive Recording Layer]

| | |
|---|---|
| Dispersion A3 | 100 parts |
| Dispersion B3 | 100 parts |
| Dispersion C3 | 100 parts |
| 10% Aqueous polyvinyl alcohol solution | 200 parts |
| 30% Aqueous dispersion of light calcium carbonate | 100 parts |
| 40% Aqueous zinc stearate dispersion | 25 parts |
| Water | 60 parts |

(3) Production of Thermal Recording Material

To the support having an intermediate layer, which was prepared in the above (1), coating liquid 3 for forming a heat-sensitive recording layer was applied so that the coating amount might be 0.5 g/m$^2$ in terms of a dye precursor, and then calendering was performed. Thus, a thermal recording material was produced.

Example 14

The same procedures as described in Example 13 were performed to give a thermal recording material, except that a dispersion described below was used instead of 20 parts of the aqueous EVA copolymer wax dispersion AQUATIX8421 in the preparation of a support having an intermediate layer. The dispersion used was prepared by dispersing 4 parts of an EVA copolymer wax powder, A-C400A (manufactured by Honeywell International Inc.) in 16 parts of a 2.5% aqueous sulfonic acid-modified polyvinyl alcohol solution, followed by wet bead milling to obtain a dispersion having a volume-average particle diameter of 3.0 μm.

Example 15

The same procedures as described in Example 13 were performed to give a thermal recording material, except for using 10 parts of an aqueous EVA copolymer wax dispersion, CHEMIPEARL V-200 (manufactured by Mitsui Chemicals, Inc., nonvolatile content: 40%, average particle diameter: 6 to 8 μm) instead of 20 parts of the aqueous EVA copolymer wax dispersion. AQUATIX8421 in the preparation of a support having an intermediate layer.

Example 16

The same procedures as described in Example 13 were performed to give a thermal recording material, except for using 100 parts of Expancel 461-20DU (manufactured by AkzoNovel, average particle diameter before thermal expansion: 6 to 9 μm, expansion starting temperature: 100 to 106° C., expansion ratio: about 35 fold) instead of 100 parts of the heat-expandable resin particle Expancel 053-40DU in the preparation of a support having an intermediate layer.

Example 17

The same procedures as described in Example 13 were performed to give a thermal recording material, except that the aqueous EVA copolymer wax dispersion AQUATIX8421 was not used in the preparation of a support having an intermediate layer.

Example 18

The same procedures as described in Example 13 were performed to give a thermal recording material, except for using 10 parts of an aqueous polyethylene wax dispersion, CHEMIPEARL W-400 (manufactured by Mitsui Chemicals, Inc., nonvolatile content: 40%, average particle diameter: 3 to 5 μm) instead of 20 parts of the aqueous EVA copolymer wax dispersion AQUATIX8421 in the preparation of a support having an intermediate layer.

Example 19

The same procedures as described in Example 13 were performed to give a thermal recording material, except for using 7.3 parts of Sumikaflex S-510HQ, an adhesive in the form of an aqueous dispersion of an EVA copolymer (manufactured by Sumika Chemtex Co., Ltd., nonvolatile content: 55%, average particle diameter: 0.6 to 0.8 μm) instead of 20 parts of the aqueous EVA copolymer wax dispersion AQUATIX8421 in the preparation of a support having an intermediate layer.

Comparative Example 11

The same procedures as described in Example 13 were performed to give a thermal recording material, except that the drying was performed while the temperature of the coated paper surface was kept at 130° C. to allow the heat-expandable resin particle to expand and that the subsequent thermal calendering was not performed in the preparation of a support having an intermediate layer.

Comparative Example 12

The same procedures as described in Example 13 were performed to give a thermal recording material, except that 100 parts of a non-expanding hollow resin particle, HP-91 (manufactured by Rohm and Haas Company Japan, average particle diameter: 1.0 μm, hollow ratio: 50%) was used instead of 100 parts of the heat-expandable resin particle Expancel 053-40DU in the preparation of a support having an intermediate layer.

Test Example 1

To one surface of a high-quality paper having a basis weight of 120 g/m$^2$, AQUATIX8421, the aqueous EVA copolymer wax dispersion used in Examples 13 and 16 was applied alone so that the solid coating amount might be 3 g/m$^2$. Then, drying was performed while the temperature of the coated paper surface was kept no higher than 80° C., and thus a test product was produced.

Test Example 2

To one surface of a high-quality paper having a basis weight of 120 g/m$^2$, the dispersion used in Example 14 was applied alone so that the solid coating amount might be 3 g/m$^2$. Then, drying was performed while the temperature of the coated paper surface was kept no higher than 80° C., and thus a test product was produced. The dispersion used in Example 14 was prepared by dispersing 4 parts of an EVA copolymer wax powder, A-C400A in 16 parts of a 2.5% aqueous sulfonic acid-modified polyvinyl alcohol solution, followed by wet bead milling to obtain a dispersion having a volume-average particle diameter of 3.0 μm.

Test Example 3

To one surface of a high-quality paper having a basis weight of 120 g/m$^2$, CHEMIPEARL V-200, the aqueous EVA copolymer wax dispersion used in Example 15 was applied alone so that the solid coating amount might be 3 g/m$^2$. Then, drying was performed while the temperature of the coated paper surface was kept no higher than 80° C., and thus a test product was produced.

Test Example 4

Toone surface of a high-quality paper having a basis weight of 120 g/m$^2$, CHEMIPEARL W-400, the aqueous polyethylene wax dispersion used in Example 18 was applied alone so that the solid coating amount might be 3 g/m$^2$. Then, drying was performed while the temperature of the coated paper surface was kept no higher than 80° C., and thus a test product was produced.

Test Example 5

Toone surface of a high-quality paper having a basis weight of 120 g/m$^2$, Sumikaflex S-510HQ, the aqueous EVA copolymer dispersion used in Example 19 was applied alone so that the solid coating amount might be 3 g/m$^2$. Then, drying was performed while the temperature of the coated paper surface was kept no higher than 80° C., and thus a test product was produced.

Each of the produced thermal recording materials was evaluated as below. The evaluation results are shown in Table 3.

Evaluation 1 [Confirmation of Bellows Shape]

Cross-section preparation of the thermal recording materials produced in Examples 13 to 19 and Comparative Examples 11 and 12 was performed by ion milling, and the resulting cross sections were observed with the scanning electron microscope S-2300 manufactured by Hitachi, Ltd. for confirmation of a bellows shape. In the case where a bellows shape was confirmed, the ratio of Da/2 to La, i.e., (Da/2)/La was determined. As previously described with reference to FIG. 5, L is defined as a vertical length between a curved surface A on the support 1 side of a hollow resin-containing intermediate layer 3 and a curved surface B, which is opposed to the curved surface A and located on the heat-sensitive recording layer 2 side of the hollow resin-containing intermediate layer 3; A' and B' are defined as virtual planes by which curved surfaces A and B with a continuously-varying curvature are approximated, respectively; La is defined as the average in the length L; and the average fold depth in a lateral surface of a cell is defined as a half (Da/2) of the average (Da) in a peak-to-peak distance D between folds 3*a* and 3*b*, which are adjacent to each other and protrude forward and backward along the direction parallel to virtual planes A' and B'.

Evaluation 2 [PPS Roughness]

The color forming surface of each of the thermal recording materials produced in Examples 13 to 19 and Comparative Examples 11 and 12 was measured for roughness with the roughness tester Parker Print Surf manufactured by TESTING MACHINES INC., U.S.A.

Evaluation 3 [Quality of Recorded Halftone Images]

On each of the thermal recording materials produced in Examples 13 to 19 and Comparative Examples 11 and 12, printing was performed in the same manner as in the above-mentioned recorded image quality test on the thermal recording materials produced in Examples 1 to 8 and Comparative Examples 1 to 7. The text print quality was visually evaluated. The evaluation criteria are the same as those applied to Examples 1 to 8 and Comparative Examples 1 to 7.

Evaluation 4 [Thermal Responsiveness]

On each of the thermal recording materials produced in Examples 13 to 19 and Comparative Examples 11 and 12, solid printing was performed in the same manner as in the above-mentioned thermal responsiveness test on the thermal recording materials produced in Examples 1 to 8 and Comparative Examples 1 to 7. The print density of the solid image was measured by the reflection densitometer model RD-19 manufactured by GretagMacbeth. The evaluation criteria are the same as those applied to Examples 1 to 8 and Comparative Examples 1 to 7.

Evaluation 5 [Color Density Uniformity]

On each of the thermal recording materials produced in Examples 13 to 19 and Comparative Examples 11 and 12, printing was performed using the printing tester TH-PMD manufactured by Okura Engineering Co., LTD. The tester was equipped with a thermal head featuring a dot density of 8 dots/mm and a head resistance of 1685Ω, and solid printing was performed at an applied voltage of 21 V and at an applied pulse-width of 1.6 msec in such a manner that the print density might not be below the saturation value. The print density nonuniformity (print mottle) of the solid image was visually evaluated. The evaluation criteria used are as follows.

A: Print density is almost uniform.

B: Print density is slightly nonuniform, but practically acceptable.

C: Print density is nonuniform.

D: Print density is markedly nonuniform.

Evaluation 6 [Coating Layer Strength]

Each of the thermal recording materials produced in Examples 13 to 19 and Comparative Examples 11 and 12 was evaluated for coating layer strength by use of the printability tester model RI-1 manufactured by IHI Machinery and Furnace Co., Ltd. and an ink having a tack value of 20 (manufactured by DIC Corporation). The printing conditions were set at an ink volume of 0.4 ml and a rotation speed of 50 rpm. The evaluation criteria used are as follows.

A: Almost free from picking.

B: Picking is slightly observed, but practically acceptable.

C: Picking is observed.

D: Extensive picking is observed.

Next, the coated papers produced in Test Examples, i.e., papers coated with an EVA copolymer wax or the like, were evaluated as below. The evaluation results are shown in Table 4.

Evaluation 7 [Strength of EVA Copolymer Wax Coating Layer]

Each of the coated papers produced in Test Examples 1 to 5 was evaluated for coating layer strength in the same manner as in Evaluation 6 by use of the printability tester model RI-1 manufactured by IHI Machinery and Furnace Co., Ltd. and an ink having a tack value of 20 (manufactured by DIC Corporation). The printing conditions were set at an ink volume of 0.4 ml and a rotation speed of 50 rpm. The evaluation criteria used are as follows.

A: Almost free from picking.

B: Picking is slightly observed, but practically acceptable.

C: Picking is observed.

D: Extensive picking is observed.

TABLE 3

| | Ev 1 | | Ev 2 | Ev 3 | | | Ev 4 | | Ev 5 | Ev 6 |
|---|---|---|---|---|---|---|---|---|---|---|
| | Bellows shape | Average fold | PPS roughness | Quality of recorded halftone images | | | Thermal responsiveness | | Color density uniformity | Coating layer |
| | formation | depth | [μm] | 0.2 msec | 0.4 msec | 0.6 msec | 0.6 msec | 1.0 msec | 1.6 msec | strength |
| Ex 13 | Formed | 1/11 | 0.5 | B | A | A | B | A | A | A |
| Ex 14 | Formed | 1/14 | 0.8 | B | B | A | B | B | A | B |
| Ex 15 | Formed | 1/15 | 0.9 | B | B | A | B | B | B | B |
| Ex 16 | Formed | 1/12 | 0.3 | B | A | A | B | A | A | A |
| Ex 17 | Formed | 1/15 | 1.0 | B | B | B | B | A | C | D |
| Ex 18 | Formed | 1/15 | 0.9 | B | B | A | B | A | C | D |
| Ex 19 | Formed | 1/15 | 1.0 | B | B | B | B | A | C | D |

TABLE 3-continued

| | Ev 1 | | Ev 2 | Ev 3 | | | Ev 4 | | Ev 5 | Ev 6 |
|---|---|---|---|---|---|---|---|---|---|---|
| | Bellows shape formation | Average fold depth | PPS roughness [μm] | Quality of recorded halftone images 0.2 msec | 0.4 msec | 0.6 msec | Thermal responsiveness 0.6 msec | 1.0 msec | Color density uniformity 1.6 msec | Coating layer strength |
| CEx 11 | Not formed | — | 1.1 | C | C | B | B | B | D | D |
| CEx 12 | Not formed | — | 1.4 | D | D | C | C | A | B | A |

TABLE 4

| | Ev 7 Coating layer strength |
|---|---|
| Test Example 1 | D |
| Test Example 2 | D |
| Test Example 3 | D |
| Test Example 4 | D |
| Test Example 5 | A |

As is clear from the results in Table 3, the thermal recording materials of Examples 13 to 16, each of which comprises an intermediate layer containing a bellows-shaped hollow resin and an EVA copolymer wax, are excellent not only in quality of recorded halftone images and thermal responsiveness, but also in color density uniformity and coating layer strength. As is clear from the results in Table 4, Test Examples 1 to 4 show that the EVA copolymer waxes used in Examples 13 to 16 substantially have no binding effect.

Example 20

(1) Preparation of Support Having Intermediate Layer

First, 100 parts of a heat-expandable resin particle, Expancel 053-40DU (manufactured by AkzoNovel, average particle diameter before thermal expansion: 10 to 16 μm, expansion starting temperature: 96 to 103° C., expansion ratio: about 50 fold) was dispersed in 200 parts of a 10% aqueous polyvinyl alcohol solution. To a high-quality paper having a density of 0.8 g/cm$^3$ and a basis weight of 120 g/m$^2$, the prepared dispersion was applied so that the solid coating amount might be 10 g/m$^2$. Next, drying was performed while the temperature of the coated paper surface was kept no higher than 80° C. Then, thermoforming was performed using a 3-roll thermal calender having two nips formed by three vertically stacked rolls with a diameter of 500 mm. The conditions were as follows: the linear pressure was 500 N/cm, the processing temperature was 150° C., the processing speed was 40 m/min, and the contact time of the coating surface and the thermal roll was about 1 second. Thus, a support having an intermediate layer was obtained.

(2) Preparation of Coating Liquid for Forming Heat-Sensitive Recording Layer <Dispersion A4>

In 70 parts of a 2.5% aqueous polyvinyl alcohol solution, 30 parts of 3-di-n-butylamino-6-methyl-7-anilinofluoran was dispersed and then ground by a bead mill until the volume-average particle diameter became 0.8 μm. Thus, dispersion A4 was prepared.

<Dispersion B4>

In 70 parts of a 2.5% aqueous polyvinyl alcohol solution, parts of 4-hydroxy-4'-isopropoxy diphenylsulfone was dispersed and then ground by a bead mill until the volume-average particle diameter became 0.7 μm. Thus, dispersion B4 was prepared.

<Dispersion C4>

In 70 parts of a 2.5% aqueous polyvinyl alcohol solution, 30 parts of benzyl-2-naphthyl ether was dispersed and then ground by a bead mill until the volume-average particle diameter became 0.8 μm. Thus, dispersion C4 was prepared.

These dispersions were mixed in the following blending ratio and stirred well to give coating liquid 4 for forming a heat-sensitive recording layer.

[Coating Liquid 4 for Forming a Heat-Sensitive Recording Layer]

| | |
|---|---|
| Dispersion A4 | 100 parts |
| Dispersion B4 | 100 parts |
| Dispersion C4 | 100 parts |
| 10% Aqueous polyvinyl alcohol solution | 150 parts |
| 30% Aqueous dispersion of light calcium carbonate | 30 parts |
| 40% Aqueous zinc stearate dispersion | 10 parts |
| Water | 30 parts |

(3) Preparation of Coating Liquid for Forming Protective Layer

Essential components were mixed in the following blending ratio and stirred well to give a coating liquid for forming a protective layer.

| | |
|---|---|
| 20% Core-shell structured acrylic emulsion (manufactured by Mitsui Chemicals, Inc., trade name: BM-1000) | 25 parts |
| 10% Aqueous diacetone-modified polyvinyl alcohol solution | 350 parts |
| 40% Aqueous aluminum hydroxide dispersion | 100 parts |
| 40% Aqueous zinc stearate dispersion | 25 parts |
| 10% Aqueous solution of adipic acid dihydrazide | 35 parts |
| Water | 365 parts |

(4) Production of Thermal Recording Material

To the support having an intermediate layer, which was prepared in the above (1), coating liquid 4 for forming a heat-sensitive recording layer, which was prepared in the above (2), was applied so that the coating amount might be 0.5 g/m$^2$ in terms of a dye precursor, and then calendering was performed. Next, the coating liquid for forming a protective layer, which was prepared in the above (3), was applied so that the coating amount might be 3.0 g/m$^2$, and then calendering was performed. Thus, a thermal recording material was produced.

Example 21

The same procedures as described in Example 20 were performed to give a thermal recording material, except for changing the components and their blending ratio as below in the preparation of a coating liquid for forming a protective layer.

| | |
|---|---|
| 20% Core-shell structured acrylic emulsion (manufactured by Mitsui Chemicals, Inc., trade name: BM-1000) | 50 parts |
| 10% Aqueous diacetone-modified polyvinyl alcohol solution | 300 parts |
| 40% Aqueous aluminum hydroxide dispersion | 100 parts |
| 40% Aqueous zinc stearate dispersion | 25 parts |
| 10% Aqueous solution of adipic acid dihydrazide | 30 parts |
| Water | 395 parts |

Example 22

The same procedures as described in Example 20 were performed to give a thermal recording material, except for changing the components and their blending ratio as below in the preparation of a coating liquid for forming a protective layer.

| | |
|---|---|
| 20% Core-shell structured acrylic emulsion (manufactured by Mitsui Chemicals, Inc., trade name: BM-1000) | 100 parts |
| 10% Aqueous diacetone-modified polyvinyl alcohol solution | 200 parts |
| 40% Aqueous aluminum hydroxide dispersion | 100 parts |
| 40% Aqueous zinc stearate dispersion | 25 parts |
| 10% Aqueous solution of adipic acid dihydrazide | 20 parts |
| Water | 455 parts |

Example 23

The same procedures as described in Example 20 were performed to give a thermal recording material, except for changing the components and their blending ratio as below in the preparation of a coating liquid for forming a protective layer.

| | |
|---|---|
| 20% Core-shell structured acrylic emulsion (manufactured by Mitsui Chemicals, Inc., trade name: BM-1000) | 150 parts |
| 10% Aqueous diacetone-modified polyvinyl alcohol solution | 100 parts |
| 40% Aqueous aluminum hydroxide dispersion | 100 parts |
| 40% Aqueous zinc stearate dispersion | 25 parts |
| 10% Aqueous solution of adipic acid dihydrazide | 10 parts |
| Water | 515 parts |

Example 24

The same procedures as described in Example 20 were performed to give a thermal recording material, except for changing the components and their blending ratio as below in the preparation of a coating liquid for forming a protective layer.

| | |
|---|---|
| 20% Core-shell structured acrylic emulsion (manufactured by Mitsui Chemicals, Inc., trade name: BM-1000) | 100 parts |
| 10% Aqueous acetoacetyl-modified polyvinyl alcohol solution | 200 parts |
| 40% Aqueous aluminum hydroxide dispersion | 100 parts |
| 40% Aqueous zinc stearate dispersion | 25 parts |
| 10% Aqueous solution of adipic acid dihydrazide | 20 parts |
| Water | 455 parts |

Example 25

The same procedures as described in Example 20 were performed to give a thermal recording material, except for changing the components and their blending ratio as below in the preparation of a coating liquid for forming a protective layer.

| | |
|---|---|
| 20% Core-shell structured acrylic emulsion (manufactured by Mitsui Chemicals, Inc., trade name: BM-1000) | 100 parts |
| 10% Aqueous carboxyl-modified polyvinyl alcohol solution | 200 parts |
| 40% Aqueous aluminum hydroxide dispersion | 100 parts |
| 40% Aqueous zinc stearate dispersion | 25 parts |
| 25% Aqueous solution of polyamide-epichlorohydrin resin | 16 parts |
| Water | 459 parts |

Example 26

The same procedures as described in Example 20 were performed to give a thermal recording material, except for changing the components and their blending ratio as below in the preparation of a coating liquid for forming a protective layer.

| | |
|---|---|
| 20% Core-shell structured acrylic emulsion (manufactured by Mitsui Chemicals, Inc., trade name: BM-1000) | 100 parts |
| 10% Aqueous unmodified polyvinyl alcohol solution | 200 parts |
| 40% Aqueous aluminum hydroxide dispersion | 100 parts |
| 40% Aqueous zinc stearate dispersion | 25 parts |
| 10% Aqueous solution of adipic acid dihydrazide | 20 parts |
| Water | 455 parts |

Example 27

The same procedures as described in Example 20 were performed to give a thermal recording material, except for changing the components and their blending ratio as below in the preparation of a coating liquid for forming a protective layer.

| | |
|---|---|
| 20% Core-shell structured acrylic emulsion (manufactured by Mitsui Chemicals, Inc., trade name: BM-1000) | 200 parts |
| 40% Aqueous aluminum hydroxide dispersion | 100 parts |
| 40% Aqueous zinc stearate dispersion | 25 parts |
| 10% Aqueous solution of adipic acid dihydrazide | 20 parts |
| Water | 555 parts |

Example 28

The same procedures as described in Example 20 were performed to give a thermal recording material, except for changing the components and their blending ratio as below in the preparation of a coating liquid for forming a protective layer.

| | |
|---|---|
| 10% Aqueous diacetone-modified polyvinyl alcohol solution | 400 parts |
| 40% Aqueous aluminum hydroxide dispersion | 100 parts |
| 40% Aqueous zinc stearate dispersion | 25 parts |
| 10% Aqueous solution of adipic acid dihydrazide | 40 parts |
| Water | 335 parts |

Example 29

The same procedures as described in Example 20 were performed to give a thermal recording material, except for changing the components and their blending ratio as below in the preparation of a coating liquid for forming a protective layer.

| | |
|---|---|
| 10% Aqueous acetoacetyl-modified polyvinyl alcohol solution | 400 parts |
| 40% Aqueous aluminum hydroxide dispersion | 100 parts |
| 40% Aqueous zinc stearate dispersion | 25 parts |
| 10% Aqueous solution of adipic acid dihydrazide | 40 parts |
| Water | 335 parts |

Example 30

The same procedures as described in Example 20 were performed to give a thermal recording material, except for changing the components and their blending ratio as below in the preparation of a coating liquid for forming a protective layer.

| | |
|---|---|
| 10% Aqueous carboxyl-modified polyvinyl alcohol solution | 400 parts |
| 40% Aqueous aluminum hydroxide dispersion | 100 parts |
| 40% Aqueous zinc stearate dispersion | 25 parts |
| 25% Aqueous solution of polyamide-epichlorohydrin resin | 32 parts |
| Water | 343 parts |

Each of the produced thermal recording materials was evaluated as below. The evaluation results are shown in Table 5.

Evaluation 1 [Confirmation of Bellows Shape]

Cross-section preparation of the thermal recording materials produced in Examples 20 to 30 was performed by ion milling, and the resulting cross sections were observed with the scanning electron microscope S-2300 manufactured by Hitachi, Ltd. for confirmation of a bellows shape. In the case where a bellows shape was confirmed, the ratio of Da/2 to La, i.e., (Da/2)/La was determined. As previously described with reference to FIG. 5, L is defined as a vertical length between a curved surface A on the support 1 side of a hollow resin-containing intermediate layer 3 and a curved surface B, which is opposed to the curved surface A and located on the heat-sensitive recording layer 2 side of the hollow resin-containing intermediate layer 3; A' and B' are defined as virtual planes by which curved surfaces A and B with a continuously-varying curvature are approximated, respectively; La is defined as the average in the length L; and the average fold depth in a lateral surface of a cell is defined as a half (Da/2) of the average (Da) in a peak-to-peak distance D between folds 3*a* and 3*b*, which are adjacent to each other and protrude forward and backward along the direction parallel to virtual planes A' and B'.

Evaluation 2 [PPS Roughness]

The color forming surface of each of the thermal recording materials produced in Examples 20 to 30 was measured for roughness with the roughness tester Parker Print Surf manufactured by TESTING MACHINES INC., U.S.A.

Evaluation 3 [Dot Reproducibility of Halftone Images]

On each of the thermal recording materials produced in Examples 20 to 30, printing was performed in the same manner as in the above-mentioned recorded image quality test on the thermal recording materials produced in Examples 1 to 8 and Comparative Examples 1 to 7. The text print quality was visually evaluated. The evaluation criteria are the same as those applied to Examples 1 to 8 and Comparative Examples 1 to 7.

Evaluation 4 [Thermal Responsiveness]

On each of the thermal recording materials produced in Examples 20 to 30, solid printing was performed in the same manner as in the above-mentioned thermal responsiveness test on the thermal recording materials produced in Examples 1 to 8 and Comparative Examples 1 to 7. The print density of the solid image was measured by the reflection densitometer model RD-19 manufactured by GretagMacbeth. The evaluation criteria are the same as those applied to Examples 1 to 8 and Comparative Examples 1 to 7.

Evaluation 5 [Color Density Uniformity]

On each of the thermal recording materials produced in Examples 20 to 30, solid printing was performed in the same manner as in the above-mentioned color density uniformity test on the thermal recording materials produced in Examples 13 to 19 and Comparative Examples 11 and 12. The print density nonuniformity (print mottle) of the solid image was visually evaluated. The evaluation criteria are the same as those applied to Examples 13 to 19 and Comparative Examples 11 and 12.

Evaluation 6 [Anti-Sticking Property]

On each of the thermal recording materials produced in Examples 20 to 30, test printing was performed at ordinary temperature of 20° C. and at a relative humidity of 65% using a handheld terminal printer manufactured by Canon, Inc. (trade name: PREA CT-1). Sticking noise and partially missing print (white horizontal line pattern) were evaluated. The evaluation criteria used are as follows.

A: Almost free from sticking noise and defective print.

B: Sticking noise and defective print are slightly observed, but practically acceptable.

C: Sticking noise and defective print are observed.

D: Intense sticking noise and extensive, defective print are observed.

Evaluation 7 [Chemical Resistance]

To the thermal recording surface of each of the thermal recording materials produced in Examples 20 to 30, a 10% aqueous ethanol solution was applied by use of a swab soaked therewith, and the degree of color development on the background was evaluated.

A: Almost free from undesired color development.

B: Undesired color development is slightly observed, but practically acceptable.

C: Undesired color development gradually proceeds after chemical application.

D: Marked, undesired color development is observed immediately after chemical application.

TABLE 5

| | Ev 1 | | Ev 2 | Ev 3 | | | Ev 4 | | Ev 5 | Ev 6 | |
|---|---|---|---|---|---|---|---|---|---|---|---|
| | Bellows shape formation | Average fold depth | PPS roughness [μm] | Quality of recorded halftone images 0.2 msec | 0.4 msec | 0.6 msec | Thermal responsiveness 0.6 msec | 1.0 msec | Color density uniformity 1.6 msec | Anti sticking property | Ev 7 Chemical resistance |
| Ex 20 | Formed | 1/15 | 0.9 | B | B | B | B | A | B | B | A |
| Ex 21 | Formed | 1/15 | 0.9 | B | B | B | B | A | A | A | A |
| Ex 22 | Formed | 1/15 | 0.9 | B | B | B | B | A | A | A | A |
| Ex 23 | Formed | 1/15 | 0.8 | B | B | B | B | A | A | A | B |
| Ex 24 | Formed | 1/15 | 0.7 | B | B | B | B | A | A | A | A |
| Ex 25 | Formed | 1/15 | 0.9 | B | B | B | B | A | A | B | A |
| Ex 26 | Formed | 1/15 | 0.9 | B | B | B | B | A | A | D | B |
| Ex 27 | Formed | 1/15 | 0.8 | B | B | B | B | A | A | A | D |
| Ex 28 | Formed | 1/15 | 1.0 | B | B | B | B | B | C | C | A |
| Ex 29 | Formed | 1/15 | 1.0 | B | B | B | B | B | C | C | A |
| Ex 30 | Formed | 1/15 | 1.0 | B | B | B | B | B | C | D | A |

As is clear from the results in Table 5, thermal recording materials provided with a protective layer containing a water-dispersible resin which has a core-shell structure consisting of a core comprising acrylonitrile as an essential component, and a shell comprising methacrylamide as an essential component; and at least one kind of water-soluble resin selected from a diacetone-modified polyvinyl alcohol, an acetoacetyl-modified polyvinyl alcohol and a carboxyl-modified polyvinyl alcohol are excellent not only in dot reproducibility of halftone images and thermal responsiveness, but also in color density uniformity, anti-sticking property and chemical resistance.

The invention claimed is:

1. A thermal recording material comprising an intermediate layer and a heat-sensitive recording layer for color formation by heat stacked in this order onto a support, the thermal recording material being characterized in that the intermediate layer contains a bellows-shaped hollow resin and that the roughness of a surface on a color forming side is 1.0 μm or less as measured by Parker Print Surf.

2. The thermal recording material according to claim 1, wherein the roughness of the surface on the color forming side is 0.8 μm or less as measured by Parker Print Surf.

3. The thermal recording material according to claim 1, wherein the roughness of the surface on the color forming side is 0.7 μm or less as measured by Parker Print Surf.

4. The thermal recording material according to claim 1, wherein the support is a soft-calendered paper having a density of 0.9 to 1.1 g/cm$^3$ and a basis weight of 30 to 100 g/m$^2$.

5. The thermal recording material according to claim 4, wherein the intermediate layer contains a bellows-shaped hollow resin and an ethylene-vinyl acetate (EVA) copolymer wax.

6. A method for producing the thermal recording material according to claim 5, comprising the steps of:

applying a coating liquid containing heat-expandable resin particles to a support, drying the coated support at a temperature lower than the expansion starting temperature of the heat-expandable resin particle, and subjecting the coated support to thermoforming for formation of an intermediate layer; and applying, to the intermediate layer, heat-sensitive recording-related components which contribute to color formation by heat, for formation of a heat-sensitive recording layer.

7. A method for producing the thermal recording material according to claim 5, comprising the steps of:

applying a coating liquid containing heat-expandable resin particles to a support, heating the coated support for thermal expansion, and performing calendering for formation of an intermediate layer; and applying, to the intermediate layer, heat-sensitive recording-related components which contribute to color formation by heat, for formation of a heat-sensitive recording layer.

8. A method for producing the thermal recording material according to claim 5, comprising the steps of:

applying a coating liquid containing heat-expandable resin particles to a support, performing thermal calendering for thermal expansion, and performing calendering for formation of an intermediate layer; and applying, to the intermediate layer, heat-sensitive recording-related components which contribute to color formation by heat, for formation of a heat-sensitive recording layer.

9. The thermal recording material according to claim 4, wherein a protective layer is provided on the heat-sensitive recording layer, the protective layer containing a water-dispersible resin which has a core-shell structure having a core comprising acrylonitrile and a shell comprising methacrylamide; and at least one water-soluble resin selected from the group consisting of a diacetone-modified polyvinyl alcohol, an acetoacetyl-modified polyvinyl alcohol and a carboxyl-modified polyvinyl alcohol.

10. The thermal recording material according to claim 9, wherein the mass ratio of the core-shell structure and the water-soluble resin is 1:5 to 2:1.

* * * * *

UNITED STATES PATENT AND TRADEMARK OFFICE

CERTIFICATE OF CORRECTION

PATENT NO. : 8,623,785 B2
APPLICATION NO. : 13/635782
DATED : January 7, 2014
INVENTOR(S) : Takahama et al.

It is certified that error appears in the above-identified patent and that said Letters Patent is hereby corrected as shown below:

ON TITLE PAGE ITEM [56] FOREIGN PATENT DOCUMENTS:

"JP 52-20142 A 6/1974" should be deleted.

In the Specification

COLUMN 1:

Line 5, "claim" should read --claims--.

COLUMN 2:

Line 3, "Literature" should read --Literature 5--;
Line 36, "INVENTION" should read --THE INVENTION--; and
Line 45, "Problem" should read --the Problem--.

COLUMN 3:

Line 63, "DRAWINGS" should read --THE DRAWINGS--.

COLUMN 4:

Line 14, "EMBODIMENTS" should read --THE EMBODIMENTS--.

COLUMN 5:

Line 26, "color forming" should read --color-forming--; and
Line 32, "color" should read --color- --.

Signed and Sealed this
Sixteenth Day of September, 2014

Michelle K. Lee

Michelle K. Lee
*Deputy Director of the United States Patent and Trademark Office*

COLUMN 7:

Line 65, “hard” should read --difficult--.

COLUMN 11:

Line 56, “color forming” should read --color-forming--.

COLUMN 12:

Line 14, “3,3-bis(p-dimethylami-” should begin a new line;
Line 28, “4,4'-bis(dimethylami-” should begin a new line;
Line 32, “rhodamine B anilinolactam,” should begin a new line;
Line 53, “benzoyl leucomethylene blue, p-ni-” should begin a new line; and
Line 55, “3-methylspirodinaphthopyran, 3-ethyl” should begin a new line.

COLUMN 13:

Line 3, “4-hydroa-4'-n-pro-” should read --4-hydrox-4'-n-pro- --.

COLUMN 14:

Line 66, “amass” should read --a mass--.

COLUMN 19:

Line 29, “pressure” should read --pressure- --.

COLUMN 32:

Line 41, “Toone” should read --To one--; and
Line 51, “Toone” should read --To one--.

In the Claims

COLUMN 41:

Claim 1, Line 62, “color forming” should read --color-forming--; and
Claim 2, Line 66, “color forming” should read --color-forming--.

COLUMN 42:

Claim 3, Line 2, “color forming” should read --color-forming--.